United States Patent [19]

Furutachi et al.

[11] Patent Number: 5,001,045

[45] Date of Patent: Mar. 19, 1991

[54] SILVER HALIDE COLOR PHOTOGRAPHIC MATERIAL CONTAINING SPARINGLY WATER SOLUBLE EPOXY COMPOUND AND ORGANIC SOLUBLE POLYMER

[75] Inventors: Nobuo Furutachi; Osamu Takahashi, both of Kanagawa, Japan

[73] Assignee: Fuji Photo Film Co., Ltd., Kanagawa, Japan

[21] Appl. No.: 234,872

[22] Filed: Aug. 22, 1988

[30] Foreign Application Priority Data

Aug. 20, 1987 [JP] Japan ..... 62-207255

[51] Int. Cl.[5] ..... G03C 7/26; G03C 7/36

[52] U.S. Cl. ..... 430/545; 430/546; 430/551; 430/627

[58] Field of Search ..... 430/551, 546, 545, 627

[56] References Cited

U.S. PATENT DOCUMENTS

| | | | |
|---|---|---|---|
| 3,619,195 | 11/1971 | Van Campen | 430/545 |
| 4,201,589 | 5/1980 | Sakaguchi et al. | 430/627 |
| 4,239,851 | 12/1980 | Aoki et al. | 430/546 |
| 4,540,667 | 9/1985 | Krishnamurthy | 430/546 |

FOREIGN PATENT DOCUMENTS

| | | |
|---|---|---|
| 0213700 | 11/1987 | European Pat. Off. . |
| 2015184 | 9/1979 | United Kingdom . |

OTHER PUBLICATIONS

Patent Abstracts of Japan, vol. 11, No. 276 (P613)[2723], 8th Sep. 1987.

Research Disclosure, No. 195, Jul. 1980, pp. 301-310, disclosure No. 19551.

*Primary Examiner*—Richard L. Schilling

*Attorney, Agent, or Firm*—Sughrue, Mion, Zinn, Macpeak & Seas

[57] ABSTRACT

A silver halide color photographic material composed of a support having thereon at least one light-sensitive silver halide emulsion layer, at least one layer thereof containing a yellow coupler represented by formula (I), a sparingly water-soluble epoxy compound represented by formula (II) and a water-insoluble but organic solvent-soluble homopolymer or copolymer:

(I)

wherein $R_{11}$ represents an N-arylcarbamoyl group; and $Z_{11}$ represents a group capable of being released by a reaction with the oxidation product of an aromatic primary amine color developing agent; and (II)

wherein $R_1$, $R_2$, $R_3$ and $R_4$, which may be the same or different, each represents hydrogen, an aliphatic group, an aromatic group, an aliphatic oxycarbonyl group, an aromatic oxycarbonyl group or a carbamoyl group; provided that at least one of $R_1$, $R_2$, $R_3$ and $R_4$ represents a group other than hydrogen; $R_1$, $R_2$, $R_3$ and $R_4$ contain a total of 8 to 60 carbon atoms; and $R_1$ and $R_2$, or $R_1$ and $R_3$ may be linked to form a 5-membered to 7-membered ring. Because of the combination of the particular yellow coupler, epoxy resin and polymer, the storage stability of the yellow image formed in the material is excellent.

18 Claims, No Drawings

SILVER HALIDE COLOR PHOTOGRAPHIC MATERIAL CONTAINING SPARINGLY WATER SOLUBLE EPOXY COMPOUND AND ORGANIC SOLUBLE POLYMER

FIELD OF THE INVENTION

The present invention relates to silver halide color photographic materials and, in particular, to materials containing a sparingly water-soluble epoxy compound and a water-insoluble but organic solvent-soluble homopolymer or copolymer, and having improved yellow image storage stability.

BACKGROUND OF THE INVENTION

When a silver halide photographic material is exposed and then color developed, a color image is formed by the reaction of an aromatic primary amine developing agent as oxidized with the silver halide and a dye-forming coupler.

In color image formation, a subtractive color process is often used, in which complementary yellow, magenta and cyan color images are formed for reproduction of blue, green and red colors, respectively.

As yellow couplers, phenoxy group-releasable compounds are disclosed in U.S. Pat. Nos. 3,408,194 and 3,933,501; imido group-releasable compounds in U.S. Pat. Nos. 4,022,620, 4,057,432, 4,269,936 and 4,404,274; and heterocyclic group-releasable compounds in U.S. Pat. Nos. 4,046,575 and 4,326,024. Using these couplers, increases in coloring rate and fastness of color images formed are still desired.

In order to improve the fastness of the color images formed from these yellow couplers, U.S. Pat. No. 4,268,593 has proposed hindered amine compounds.

However, as compared with remarkable progress in the improvement of the fastness of magenta color images and cyan color images, the fastness of yellow color images is insufficient, and still remains at a low level. Accordingly, the improvement of the fastness of cyan color images is strongly desired in this technical field.

In color photographs, it is desired that all of the yellow, magenta and cyan color images be uniformly fast to light, heat and wet heat, and that the three colors be at the same level. The present inventors have earnestly sought compounds for improving the fastness of color images formed from yellow couplers.

The epoxy compounds described in U.S. Pat. No. 4,239,851 are known to improve the fastness of cyan color images against heat and wet heat; and the epoxy compounds described in U.S. Pat. No. 4,540,657 are known to reduce the yellow stain which would result from decomposition of magenta couplers. The latter U.S. Patent further mentions that the color images from aryloxy group-releasable yellow couplers could have improved fastness to light and heat, but this effect remains insufficient. JP-A-62-75450 (the term "JP-A" as used herein means an "unexamined published Japanese patent application") discloses cyclic ether compounds for reducing stains formed by processing with particular stable processing solutions. The present inventors have found that these compounds are effective for improving the fastness of the yellow color images, in particular in the dark under humid conditions, but the improvement in antifading properties in the light remained insufficient.

In the technical field of dispersing photographic oil-soluble compounds, it is known to disperse the compounds in oil-soluble homopolymers or copolymers, for example, as described in U.S. Pat. Nos. 3,619,195, 4,201,589 and 4,120,725.

The present inventors have now found that by incorporating a yellow coupler in a photographic material together with a water-insoluble but organic solvent-soluble polymer and an epoxy compound, not only the antifading properties of the image under wet heat is improved, but also the antifading properties thereof in light is surprisingly improved.

SUMMARY OF THE INVENTION

An object of the present invention is to provide a silver halide color photographic material in which the storage stability of a yellow color image, especially when subjected to light, wet heat or dry heat is improved remarkably.

It has now been found that this and other objects of the present invention can be attained by a silver halide color photographic material composed of a support having thereon at least one light-sensitive silver halide emulsion layer, at least one layer of the material containing a yellow coupler represented by formula (I), a sparingly water-soluble epoxy compound represented by formula (II), and a water-insoluble but organic solvent-soluble homopolymer or copolymer:

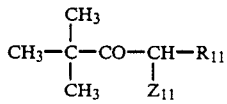

(I)

wherein $R_{11}$ represents an N-arylcarbamoyl group; and $Z_{11}$ represents a group capable of being released by reaction with the oxidation product of an aromatic primary amine color developing agent; and

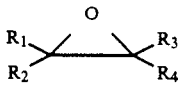

(II)

wherein $R_1$, $R_2$, $R_3$ and $R_4$, which may be the same or different, each represents hydrogen, an aliphatic group, an aromatic group, an aliphatic oxycarbonyl group, an aromatic oxycarbonyl group or a carbamoyl group, provided that at least one of $R_1$, $R_2$, $R_3$ and $R_4$ represents a group other than hydrogen, and $R_1$, $R_2$, $R_3$ and $R_4$ contain a total of 8 to 60 carbon atoms, and $R_1$ and $R_2$, or $R_1$ and $R_3$ may be linked to form a 5-membered to 7-membered ring.

DETAILED DESCRIPTION OF THE INVENTION

The yellow couplers of formula (I), the epoxy compounds of formula (II) and the water-insoluble but organic solvent-soluble polymers for use in the present invention are now explained in detail. The term "water-insoluble but organic solvent-soluble" is hereinafter referred to as "oil-soluble".

In formula (I), $R_{11}$ represents an N-arylcarbamoyl group, and the aryl (preferably phenyl) moiety of the group may optionally be substituted. Preferred substituents for the moiety include an aliphatic group having from 1 to 32 carbon atoms (e.g., methyl, allyl, cyclopentyl), a heterocyclic group having from 1 to 46 carbon atoms (e.g., 2-pyridyl, 2-imidazolyl, 2-furyl, 6-quinolyl), an aliphatic oxy group having from 1 to 32 carbon atoms (e.g., methoxy, 2-methoxyethoxy, 2-propenyloxy), an aromatic oxy group having from 6 to 46 carbon atoms (e.g., 2,4-di-tert-amylphenoxy, 4-cyanophenoxy, 2-chlorophenoxy), an acyl group having from 1 to 46 carbon atoms (e.g., acetyl, benzoyl), an ester group having from 2 to 36 carbon atoms (e.g., butoxycarbonyl, hexadecyloxycarbonyl, phenoxycarbonyl, dodecyloxycarbonyl, methoxycarbonyl, acetoxy, benzoyloxy, tetradecyloxysulfonyl, hexadecanesulfonyloxy), an amido group having from 1 to 46 carbon atoms (e.g., acetylamino, dodecanesulfonamido, 2-butoxy-5-tert-octylphenylsulfonamido, α-(2,4-di-tert-pentylphenoxy)-butanamido, methanesulfonamido, γ-(2,4-di-tert-pentylphenoxy)butanamido, N-tetradecylcarbamoyl, N,N-dihexylcarbamoyl, N-butanesulfamoyl, N-methyl-N-tetradecanesulfamoyl), an imido group having from 2 to 36 carbon atoms (e.g., succinimido, N-hydantoinyl, 3-hexadecenylsuccinimido), a ureido group having from 1 to 36 carbon atoms (e.g., phenylureido, N,N-dimethylureido, N-[3-(2,4-di-tertpentylphenoxy)propyl]ureido), an aliphatic sulfonyl group having from 1 to 32 carbon atoms or an aromatic sulfonyl group having from 6 to 42 carbon atoms (e.g., methanesulfonyl, phenylsulfonyl, dodecanesulfonyl, 2-butoxy-5-tert-octylbenzenesulfonyl), an aliphatic thio group having from 1 to 32 carbon atoms or an aromatic thio group having from 6 to 42 carbon atoms (e.g., phenylthio, ethylthio, hexadecylthio, 4-(2,4-di-tert-phenoxyacetamido)benzylthio), a hydroxyl group, a sulfonic acid group and a halogen atom (fluorine, chlorine, bromine). When the moiety has two or more substituents, they may be the same or different.

In formula (I), $Z_{11}$ represents a coupling-releasable group, and preferred examples thereof include a halogen atom (e.g., fluorine, chlorine, bromine), an alkoxy group having from 1 to 22 carbon atoms (e.g., dodecyloxy, dodecyloxycarbonylmethoxy, methoxycarbamoylmethoxy, carboxypropyloxy), an aryloxy group having from 6 to 42 carbon atoms (e.g., 4-methylphenoxy, 4-tert-butylphenoxy, 4-methanesulfonylphenoxy, 4-(4-benzyloxyphenylsulfonyl)phenoxy, 4-(4-hydroxyphenylsulfonyl)phenoxy, 4-methoxycarbonylphenoxy), an acyloxy group having from 2 to 32 carbon atoms (e.g., acetoxy, tetradecanoyloxy, benzoyloxy), a sulfonyloxy group having from 1 to 32 carbon atoms (e.g., methanesulfonyloxy, toluenesulfonyloxy), an amido group having from 1 to 32 carbon atoms (e.g., dichloroacetylamino, methanesulfonylamino, triphenylphosphonamido), an alkoxycarbonyloxy group having from 2 to 32 carbon atoms (e.g., ethoxycarbonyloxy, benzyloxycarbonyloxy), an aryloxycarbonyloxy group having from 7 to 42 carbon atoms (e.g., phenoxycarbonyloxy), an aliphatic thio group having from 1 to 32 carbon atoms or an aromatic thio group having from 6 to 42 carbon atoms (e.g., phenylthio, dodecylthio, benzylthio, 2-butoxy-5-tert-octylphenylthio, 2,5-dioctyloxyphenylthio, 2-(2-ethoxyethoxy)-5-tert-octylphenylthio, tetrazolylthio), an imido group having from 2 to 32 carbon atoms (e.g., succinimido, hydantoinyl-, 2,4-dioxooxazolidin-3-yl, 3-benzyl-4-ethoxyhydantoin-1-yl, 3--benzylhydantoin-1-yl, 1-benzyl-2-phenyl-3,5-dioxo-1,2,4-triazolidin-4-yl, 3-benzyl-4-ethoxyhydantoin-1-yl), and an N-heterocyclic group having from 1 to 42 carbon atoms e.g., 1-pyrazolyl, 1-benzotriazolyl, 5-chloro-1,2,4-triazol-1-yl). These releasable groups may contain a photographically useful group, including, for example, a group releasing a development inhibitor, a group releasing a development accelerator and an aromatic azo group (e.g., phenylazo).

In formula (I), $R_{11}$ and $Z_{11}$ may form a dimer or a higher polymer.

Among the releasable groups for $Z_{11}$, an aryloxy group, an imido group and an N-heterocyclic group are especially preferred. In particular, an imido group and an N-heterocyclic group are more preferred, and releasable groups represented by the following formulae (III) to (V) are most preferred.

(III)

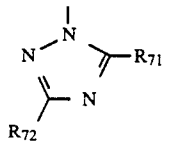

(IV)

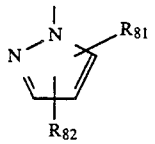

wherein $R_{71}$, $R_{72}$, $R_{81}$ and $R_{82}$, which may be the same or different, each represents hydrogen, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or a substituted or unsubstituted phenyl or heterocyclic group.

(V)

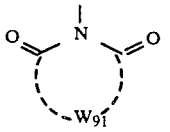

wherein $W_{91}$ represents a nonmetallic group necessary for forming a 5-membered or 6-membered ring together with

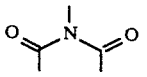

in the formula.

More preferred examples of the compounds of the formula (V) are represented by the following formulae (VI) to (VIII):

(VI)

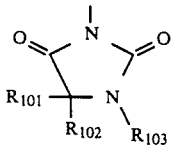

-continued (VII)

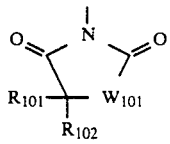

(VIII)

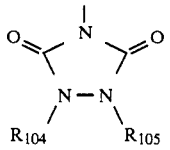

In these formulae, $R_{101}$ and $R_{102}$, which may be the same or different, each represents hydrogen, an alkyl group, an aryl group, an alkoxy group, an aryloxy group or a hydroxyl group; $R_{103}$, $R_{104}$ and $R_{105}$, which may be the same or different, each represents hydrogen, an alkyl group, an aryl group, an aralkyl group or an acyl group; and $W_{101}$ represents oxygen or sulfur.

Among the yellow couplers of the formula (I), those represented by the following formula (I-A) are more preferred.

(I-A)

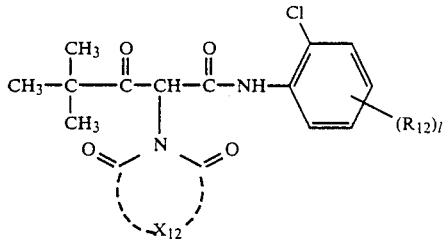

wherein $X_{12}$ represents a nonmetallic atomic group necessary for forming a 5-membered ring; and $R_{12}$ represents a substituent as previously defined for the substituted N-phenylcarbamoyl group represented b $R_{11}$, and is especially preferably an aliphatic group, an aliphatic oxy group, an aromatic oxy group, an ester group, an amido group, an imido group or a halogen atom; and l is an integer of from 1 to 4, preferably 1.

Examples of the 5-membered ring formed b $X_{12}$ include the above-mentioned groups represented by formulae (VI), (VII) and (VIII); and those represented by formulae (VI) and (VII) are especially preferred. Among the groups of the formula (VI), those where at least one of $R_{101}$ and $R_{102}$ represents a substituent other than hydrogen are most preferred.

Specific examples of the compounds of the formula (I) are described below, but the present invention is not to be construed as being limited thereto.

(I-1)

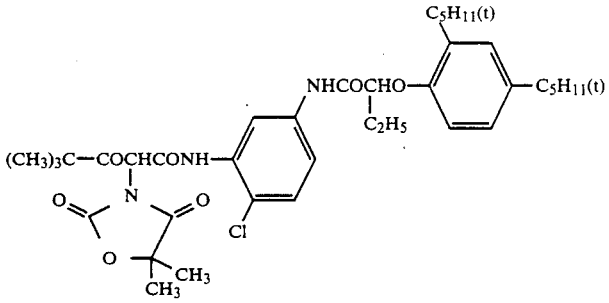

(I-2)

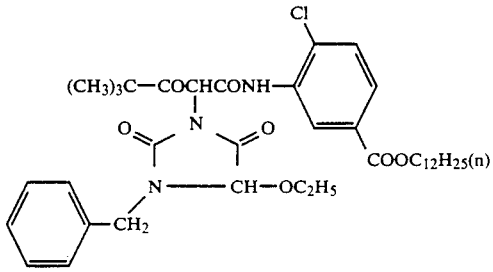

-continued
(I-3)
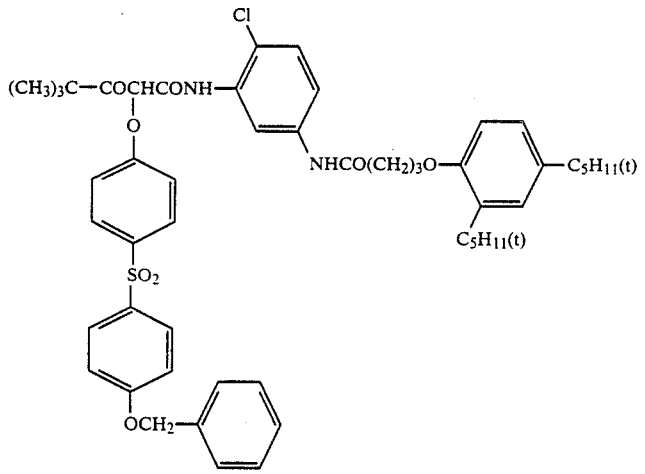
(I-4)
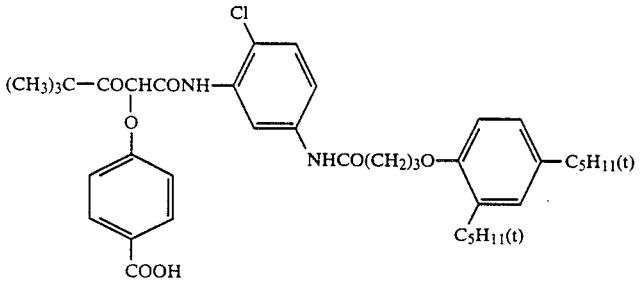
(I-5)
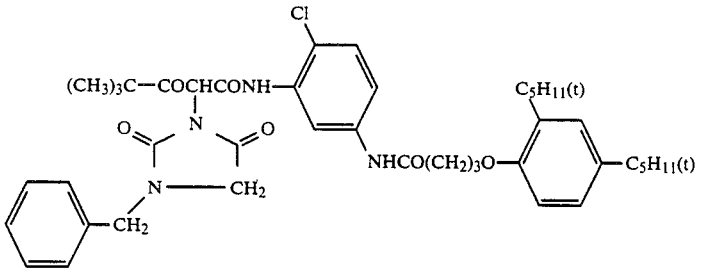
(I-6)
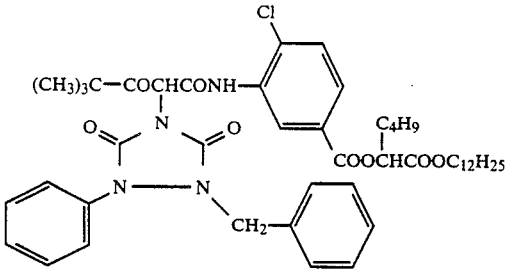
(I-7)
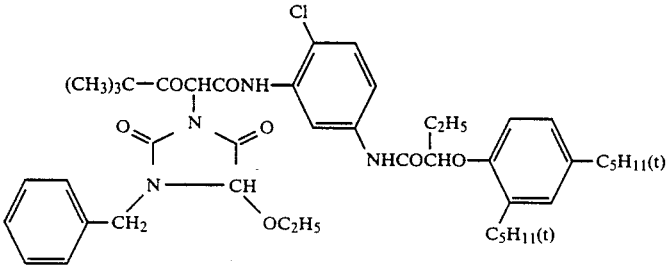

-continued
(I-8)
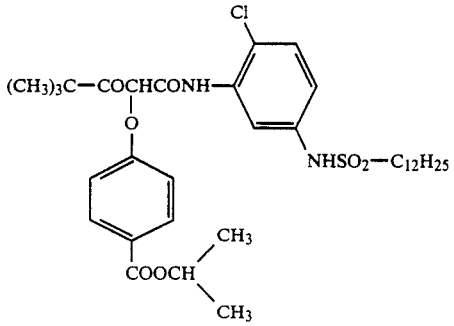
(I-9)
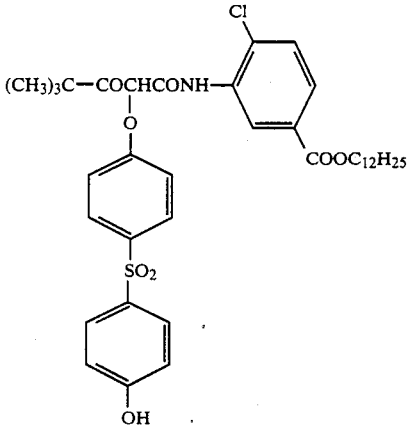
(I-10)
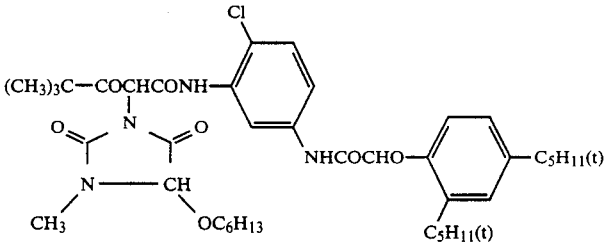
(I-11)
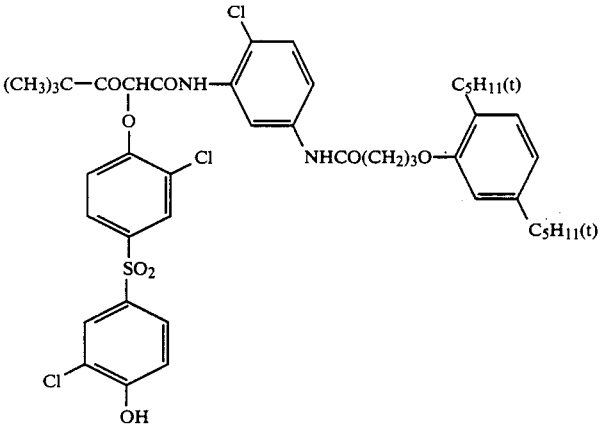
(I-12)
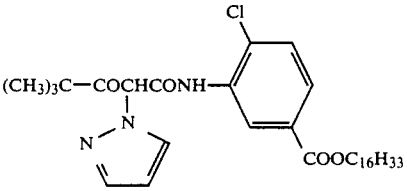

-continued
(I-13)
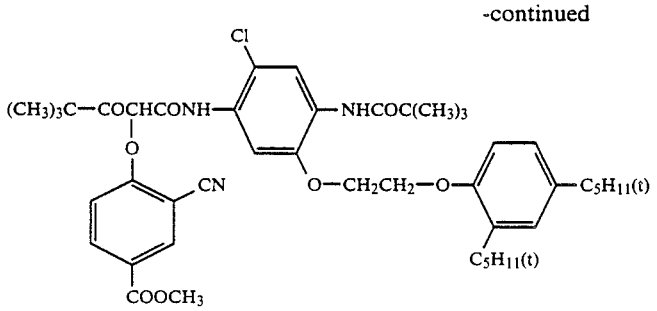
(I-14)
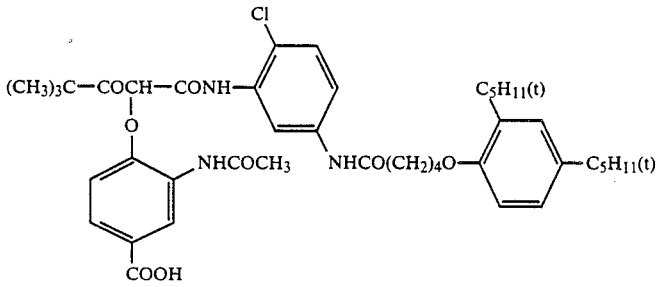
(I-15)
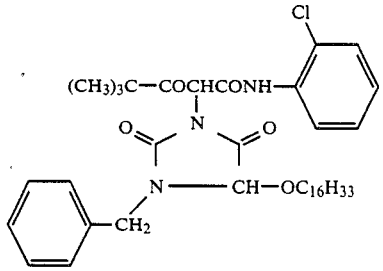
(I-16)
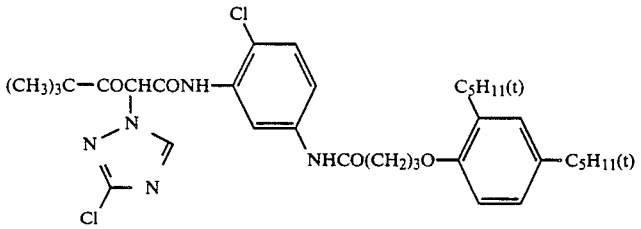
(I-17)
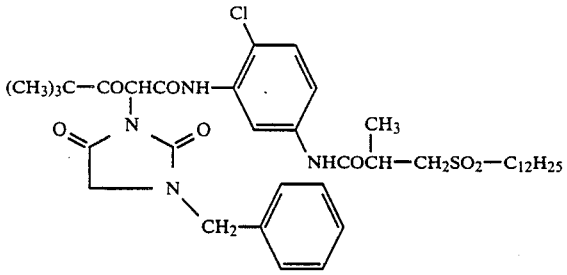
(I-18)
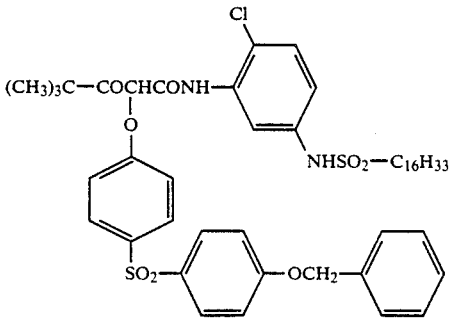

-continued (I-19)

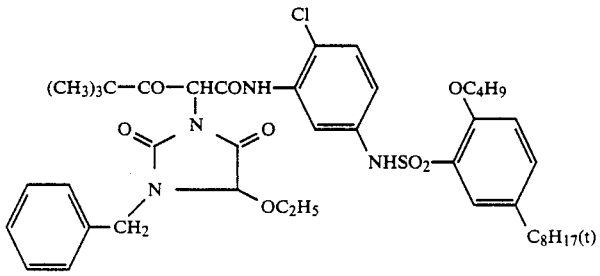

(I-20)

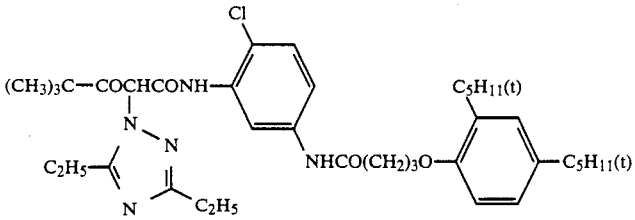

Next, formula (II) will be described in detail.

The sparingly water-soluble epoxy compounds represented by formula (II) preferably have the solubility in water at 18° C. for 1 wt % or less.

In formula (II), $R_1$, $R_2$, $R_3$ and $R_4$ each represents hydrogen, an aliphatic group, an aromatic group, an aliphatic oxycarbonyl group (e.g., dodecyloxycarbonyl, allyloxycarbonyl), an aromatic oxycarbonyl group (e.g., phenoxycarbonyl) or a carbamoyl group (e.g., tetradecylcarbamoyl, phenylmethylcarbamoyl), provided that at least one of $R_1$, $R_2$, $R_3$ and $R_4$ represents a group other than hydrogen, and the total number of carbon atoms in $R_1$, $R_2$, $R_3$ and $R_4$ is from 8 to 60, preferably from 15 to 60.

The term "aliphatic group" as used herein means a linear, branched or cyclic aliphatic hydrocarbon group and includes a saturated or unsaturated group such as an alkyl group, an alkenyl group or an alkynyl group. Specific examples of the groups include methyl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadecenyl and propargyl.

The term "aromatic group" as used herein means a substituted or unsubstituted phenyl or naphthyl group having from 6 to 42 carbon atoms. These aliphatic groups and aromatic groups may further be substituted by one or more substituent(s) selected from an alkyl group, an aryl group, a heterocyclic group, an alkoxy group (e.g., methoxy, 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (including an alkoxycarbonyl group, an aryloxycarbonyl group, an acyloxy group and a phosphoric acid ester group) (e.g., butoxycarbonyl, phenoxycarbonyl, acetoxy, benzoyloxy, butoxysulfonyl, toluenesulfonyloxy), a carboxylic acid amido group (e.g., acetylamino), a carbamoyl group (e.g., ethylcarbamoyl, dimethylcarbamoyl), a sulfonamide group (e.g., methanesulfonamido), a sulfamoyl group (e.g., butylsulfamoyl), a sulfamoylamino group (e.g., dipropylsulfamoylamino), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfonic acid group, a halogen atom or a boron amido group which may be epoxylated boron amido group with, for example, one or two epoxy alkyl group at one or two nitrogen atoms. The compounds of formula (II) may contain two or more epoxy groups in the molecule.

The compounds of formula (II) for use in the present invention and the synthetic methods thereof are disclosed, for example, in U.S. Pat. Nos. 4,239,851 and 4,540,657 and JP-A-62-75450. Specific examples of the epoxy compounds include the following compounds, but the present invention is not to be construed as being limited thereto.

(II-1)

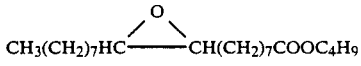

(II-2)

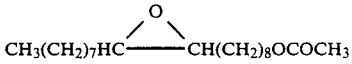

(II-3)

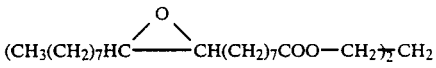

(II-4)

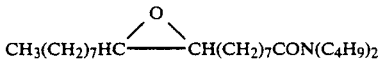

(II-5)

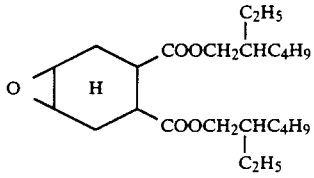

(II-6)

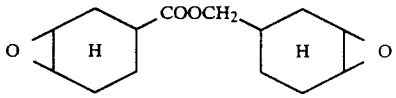

(II-7)

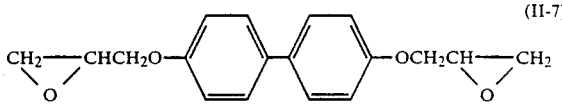

-continued (II-8)

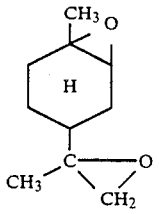

(II-9)

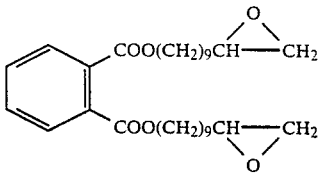

(II-10)

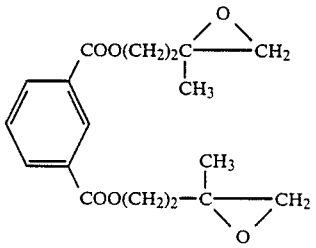

(II-11)

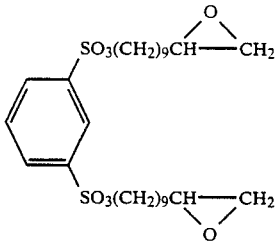

(II-12)

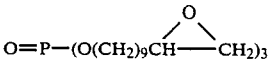

(II-13)

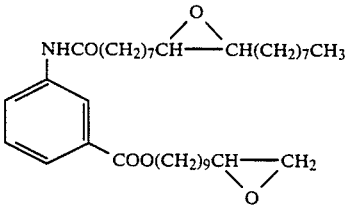

(II-14)

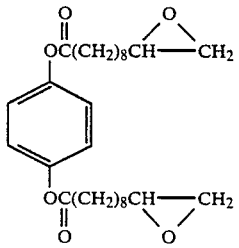

(II-15)

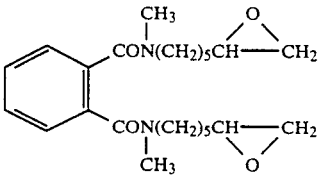

-continued (II-16)

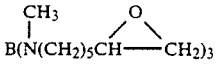

(II-17)

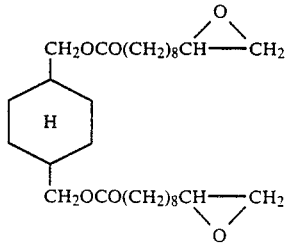

(II-18)

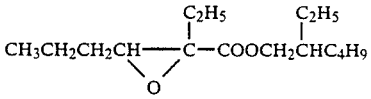

(II-19)

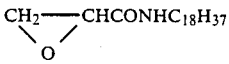

(II-20)

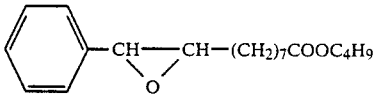

The polymer for use in the present invention may be any one which is oil-soluble. In particular, polymers having a

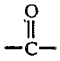

bond in the repeating units are preferred in view of their high coloring properties and antifading properties. If polymers made of acid group-containing monomers are used, the antifading properties of the polymers are extremely poor, although the reason is unknown, and, therefore, such polymers free from acid groups in the main chain or in the side chains are preferred.

As the monomers constituting the acid group-free repeating units in the polymers in the present invention, those capable of forming homopolymers (with molecular weight of.20,000 or more) which have a glass transition point (Tg) of 50° C. or higher ar preferred. More preferably, the glass transition point is 80° C. or higher. In particular, when polymers composed of monomers forming a homopolymer having a Tg of 80° C. or higher are used in the photographic materials of the present invention, the effect of improving the antifading properties of the materials is extremely increased at room temperature conditions. The tendency is especially noticeable when acrylamide or methacrylamide polymers are used, and, therefore, is extremely advantageous.

The content of the acid group-free repeating units which may constitute the polymer in the present invention is preferably 35 mol % or more, more preferably 50 mol % or more, especially preferably from 70 mol % to 100 mol %, of the polymer.

The oil-soluble polymer for use in the present invention is now explained in greater detail. The "acid group", which must not exist in the main chain or the side chains of the "acid group-free oil-soluble polymer" in the present invention, means a residue of an acid group derived from the acid molecule by removing the hydrogen atom thereof, which is substitutable by a metal, and forms the anionic moiety of a salt. Accordingly, the term "acid group-free repeating units" means those which do not have any carboxylic acids, sulfonic acids, phenols or naphthols having at least one electron-attracting group at the ortho- or para-position of the hydroxyl group and having pKa of about 10 or less, or active methylenes and their salts. Therefore, the coupler structure is considered to be "an acid group" herein.

The preferred oil-soluble homopolymer or copolymer used in the silver halide color photographic material according to the present invention has a relative quantum yield of fluorescence (K-value) of 0.20 or more, preferably 0.3 or more, with higher values being more preferable.

The above-mentioned K-value is a relative quantum yield of fluorescence of the following Compound A which is a kind of a dye widely used as a fluorescent probe in a polymer:

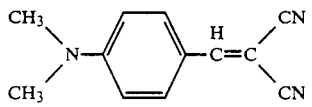

and defined by the following expression:

$$K=\phi a/\phi b$$

wherein $\phi$a and $\phi$b are the quantum yields of fluorescence of Compound A in Polymer a and Polymer b, respectively. $\phi$a and $\phi$b are determined in accordance with the method described, for example, in *Macromolecules*, 14, 587 (1981), and, more specifically, K was calculated from $\phi$a and $\phi$b determined at room temperature using two thin films of Polymer a and Polymer b each containing Compound A above in a concentration of 0.5 mM, the films being prepared on the slide glasses by spin coating with such a thickness that the absorbance at $\lambda_{max}$ of absorption by Compound A becomes 0.05 to 0.1. In the case of the present invention the above-described K-value was obtained using, as Polymer b, a polymethyl methacrylate (number average molecular weight: 20,000).

In one preferred aspect, the oil-soluble polymer for use in the present invention has a

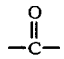

bond,

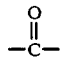

bond or

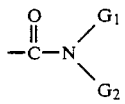

group in the main chain or the side chains thereof, in which $G_1$ and $G_2$, which may be the same or different, each represents hydrogen or a substituted or unsubstituted alkyl or aryl group. The oil-soluble polymer comprising monomer units having at least one

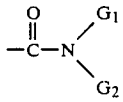

group is particularly preferred. Specific -examples of the polymers for use in the present invention are as follows, but the present invention is not to be construed as being limited thereto.

(A) Vinyl Polymers:

Monomers for forming vinyl polymers in the present invention include acrylic acid esters, which include, for example, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclo-hexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, $\omega$-methoxypolyethylene glycol acrylate (addition number of mols, n=9), 1-bromo-2-methoxyethyl acrylate and 1,1-dichloro-2-ethoxyethyl acrylate. In addition, the following monomers may also be used.

Methacrylic acid esters which include, for example, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, $\omega$-methoxypolyethylene glycol methacrylate (addition number of mols, n=6), allyl methacrylate and methacrylic acid dimethylaminoethylmethyl chloride.

Vinyl esters which include, for example, vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Acrylamides which include, for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide and diacetonacrylamide.

Methacrylamides which include, for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide.

Olefins which include, for example, dicyclopentadiene, ethylene, propylene, 1-butene, 1-pentene, vinyl chloride, vinylidene chloride, isoprene, chloroprene, butadiene and 2,3-dimethylbutadiene.

Styrenes which include, for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate.

Vinyl ethers which include, for example, methyl vinyl ether, butyl vinyl ether, hexyl vinyl ether, methoxyethyl vinyl ether and dimethylaminoethyl vinyl ether.

Other monomers which include, for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylene malonitrile and vinylidene.

The monomers (for example, the above-mentioned monomers) to be used for forming the polymers for use in the present invention can be used in combination of two or more different comonomers in accordance with various objects (for example, for improving the solubility of the resulting polymers). In order to properly control the coloring property of couplers and the solubility thereof, acid group-containing monomers, for example, those mentioned below can be used as comonomers, provided that the resulting copolymers are not soluble in water.

Usable comonomers for the purpose include, for example, acrylic acid; methacrylic acid; itaconic acid and maleic acid; monoalkyl itaconates such as monomethyl itaconate, monoethyl itaconate and monobutyl itaconate; monoalkyl maleates such as monomethyl maleate, monoethyl maleate and monobutyl maleate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid and acryloyloxypropylsulfonic acid; methacryloyloxyalkylsulfonic acids such as methacryloyloxymethylsulfonic acid, methacryloyloxyethylsulfonic acid and methacryloyloxypropylsulfonic acid; acrylamidoalkylsulfonic acids such as 2-acrylamido-2-methylethanesulfonic acid, 2-acrylamido-2-methylpropanesulfonic acid and 2-acrylamido-2-methylbutanesulfonic acid; methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid.

These acids may be in the form of salts with an alkali metal (e.g., Na, K) or an ammonium ion.

When hydrophilic monomers (which herein means that they form water-soluble homopolymers) among the above-mentioned vinyl monomers and other vinyl monomers which may be used in the present invention are used as comonomers, the proportion of the hydrophilic monomers in the resulting copolymers is not specifically limited provided that the copolymers are not soluble in water, but, in general, the proportion is preferably 40 mol % or less, more preferably 20 mol % or less, especially preferably 10 mol % or less. When the hydrophilic comonomers to be copolymerized with the monomers of the present invention have acid groups, the proportion of the acid group-containing comonomers in the resulting copolymers is generally less than 35 mol %, preferably 20 mol % or less, more preferably 10 mol % or less, from the viewpoint of the above-mentioned image storage stability. Most preferably, it is desired that the copolymers do not contain such acid group-containing comonomers.

These monomers in the polymers for use in the present invention are preferably methacrylate, acrylamide and methacrylamide monomers.

(B) Polyester Resins Obtained by Condensation of Polyhydric Alcohols and Polybasic Acids:

As polyhydric alcohols, glycols having a structure of $HO—R_1—OH$ (in which $R_1$ represents a hydrocarbon chain having from about 2 to about 12 carbon atoms, especially an aliphatic hydrocarbon chain) and polyalkylene glycols are effective; and as polybasic acids, those having a structure of $HOOC—R_2—COOH$ (in which $R_2$ represents a bond or a hydrocarbon chain having from 1 to about 12 carbon atoms) are effective.

Specific examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-diol, glycerin, diglycerin, triglycerin, 1-methylglycerin, erythritol, mannitol and sorbitol.

Specific examples of polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene-maleic anhydride adduct and rosinmaleic anhydride adduct.

(C) Other Polymers:

Other useful polymers include polyesters obtained by the ring-opening polymerization described below.

Polyesters having the following repeating units:

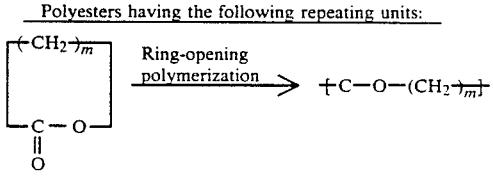

In the formula, m represents an integer of from 4 to 7, and the methylene chain ($—CH_2—$) may be branched.

Suitable monomers for forming the polyesters include, for example, β-propiolactone, ε-caprolactone and dimethylpropiolactone.

The molecular weight and the polymerization degree of the polymers of the present invention do not substantially have any significant influence on the effect of the present invention. However, if the polymers have a higher molecular weight, there is a problem that a longer time is required for dissolving them in an auxiliary solvent. In addition, since the polymers having a higher molecular weight form a liquid with a high viscosity, these are difficult to emulsify and disperse. Accordingly, these would form coarse grains, which, as a result, would cause other problems, e.g., the coloring properties of couplers would be reduced and the coatability of the coating composition would be poor. In order to overcome these problems, if a large amount of an auxiliary solvent were used to lower the viscosity of the polymer liquid, there would be other problems in the processing steps. Because of the abovementioned considerations, therefore, the viscosity of the polymers for use in the present invention is preferably 5,000 cps or less, more preferably 2,000 cps or less, in the form of a liquid of 30 g of a polymer as dissolved in 100 cc of an auxiliary solvent. The molecular weight of the polymers for use in the present invention is preferably 150,000 or less, more preferably 80,000 or less, especially preferably 30,000 or less.

The proportion of the polymer of the present invention to the auxiliary solvent depends upon the kind of the polymer used and varies in a broad range in accordance with the solubility of the polymer in the auxiliary solvent, the polymerization degree of the polymer and the solubility of the couplers as used together. In general, an auxiliary solvent is used at least in a necessary amount so that a solution of the three of a coupler, a high boiling point coupler-solvent and a polymer as dissolved in the auxiliary solvent may have a sufficiently low viscosity to be easily dispersed in water or in an aqueous hydrophilic colloid. Since the viscosity of the polymer liquid becomes higher with an increase in the polymerization degree of the polymer, the proportion of the polymer to the auxiliary solvent cannot be determined irrespective of the kind of the polymer. In general, however, it is preferred that the ratio of polymer to auxiliary solvent be from about 1/1 to about 1/50 (by weight). The proportion (by weight) of the polymer to the coupler of the present invention is preferably from 1/20 to 20/1, more preferably from 1/10 to 10/1.

Specific examples of the polymers for use in the present invention are described below, but the present invention is not to be construed as being limited thereto.

| No. | Name of Polymer | Tg (°C.) |
|---|---|---|
| (P-1) | Polyvinyl Acetate | 32 |
| (P-2) | Polyvinyl Propionate | 20 |
| (P-3) | Polymethyl Methacrylate | 105 |
| (P-4) | Polyethyl Methacrylate | 65 |
| (P-5) | Polyethyl Acrylate | −24 |
| (P-6) | Polyvinyl Acetate/Vinyl Alcohol Copolymer (95/5) | (32) |
| (P-7) | Poly-n-butyl Acrylate | −54 |
| (P-8) | Poly-n-butyl Methacrylate | 20 |
| (P-9) | Polyisobutyl Methacrylate | 53 |
| (P-10) | Polyisopropyl Methacrylate | 81 |
| (P-11) | Polydecyl Methacrylate | −70 |
| (P-12) | n-Butyl Acrylate/Acrylamide Copolymer (95/5) | (−54) |

-continued

| No. | Name of Polymer | Tg (°C.) |
|---|---|---|
| (P-13) | Polymethyl Chloroacrylate | 140 |
| (P-14) | 1,4-Butanediol/Adipic Acid Polyester | −68 |
| (P-15) | Ethylene Glycol/Sebacic Acid Polyester | — |
| (P-16) | Polycaprolactone | — |
| (P-17) | Poly(2-tert-butylphenyl acrylate) | 72 |
| (P-18) | Poly(4-tert-butylphenyl acrylate) | 71 |
| (P-19) | n-Butyl Methacrylate/N-Vinyl-2-pyrrolidone Copolymer (90/10) | (20) |
| (P-20) | Methyl Methacrylate/Vinyl Chloride Copolymer (70/30) | (105) |
| (P-21) | Methyl Methacrylate/Styrene Copolymer | (105) |
| (P-22) | Methyl Methacrylate/Ethyl Acrylate Copolymer (50/50) | (105, −24) |
| (P-23) | n-Butyl Methacrylate/Methyl Methacrylate/Styrene Copolymer (50/30/20) | (20) |
| (P-24) | Vinyl Acetate/Acrylamide Copolymer (85/15) | (32) |
| (P-25) | Vinyl Chloride/Vinyl Acetate Copolymer (65/35) | (81) |
| (P-26) | Methyl Methacrylate/Acrylonitrile Copolymer (65/35) | (105) |
| (P-27) | Diacetone Acrylamide/Methyl Methacrylate Copolymer (50/50) | (60, 105) |
| (P-28) | Vinyl Methyl Ketone/Isobutyl Methacrylate Copolymer (55/45) | (—, 53) |
| (P-29) | Ethyl Methacrylate/n-Butyl Acrylate Copolymer (70/30) | (65) |
| (P-30) | Diacetone Acrylamide/n-Butyl Acrylate Copolymer (60/40) | (60, −54) |
| (P-31) | Methyl Methacrylate/Cyclohexyl Methacrylate Copolymer (50/50) | (105, 104) |
| (P-32) | n-Butyl Acrylate/Styrene Methacrylate/Diacetone Acrylamide Copolymer (70/20/10) | (−54) |
| (P-33) | N-tert-butyl Methacrylamide/Methyl Methacrylate/Acrylic Acid Copolymer (60/30/10) | (160, 105) |
| (P-34) | Methyl Methacrylate/Styrene/Vinylsulfonamide Copolymer (70/20/10) | (105) |
| (P-35) | Methyl Methacrylate/Phenyl Vinyl Ketone Copolymer (70/30) | (105) |
| (P-36) | n-Butyl Acrylate/Methyl Methacrylate/n-Butyl Methacrylate Copolymer (35/35/30) | (−54, 105) |
| (P-37) | n-Butyl Methacrylate/Pentyl Methacrylate/N-Vinyl-2-pyrrolidone Copolymer (38/38/24) | (20, −5) |
| (P-38) | Methyl Methacrylate/n-Butyl Methacrylate/Isobutyl Methacrylate/Acrylic Acid Copolymer (37/29/25/9) | (105) |
| (P-39) | n-Butyl Methacrylate/Acrylic Acid Copolymer (95/5) | (20) |
| (P-40) | Methyl Methacrylate/Acrylic Acid Copolymer (95/5) | (105) |
| (P-41) | Benzyl Methacrylate/Acrylic Acid Copolymer (90/10) | (54) |
| (P-42) | n-Butyl Methacrylate/Methyl Methacrylate/Benzyl Methacrylate/Acrylic Acid Copolymer (35/35/25/5) | (20, 105) |
| (P-43) | n-Butyl Methacrylate/Methyl Methacrylate/Benzyl Methacrylate Copolymer (35/35/30) | (20) |
| (P-44) | Poly-3-pentyl Acrylate | (−6) |
| (P-45) | Cyclohexyl Methacrylate/Methyl Methacrylate/n-Propyl Methacrylate Copolymer (37/29/34) | (104) |
| (P-46) | Polypentyl Methacrylate | −5 |
| (P-47) | Methyl Methacrylate/n-Butyl Methacrylate Copolymer (65/35) | (105, 20) |
| (P-48) | Vinyl Acetate/Vinyl Propionate Copolymer (75/25) | (32) |
| (P-49) | n-Butyl Methacrylate/Sodium 3-Acryloxybutane-1-sulfonate Copolymer (97/3) | (20) |
| (P-50) | n-Butyl Methacrylate/Methyl Methacrylate/Acrylamide Copolymer (35/35/30) | (20, 105) |
| (P-51) | n-Butyl Methacrylate/Methyl Methacrylate/Vinyl Chloride | (20, 105) |

-continued

| No. | Name of Polymer | Tg (°C.) |
|---|---|---|
| | Copolymer (37/36/27) | |
| (P-52) | n-Butyl Methacrylate/Styrene Copolymer (90/10) | (20) |
| (P-53) | Methyl Methacrylate/N-Vinyl-2-pyrrolidone Copolymer (90/10) | (105) |
| (P-54) | n-Butyl Methacrylate/Vinyl Chloride Copolymer (90/10) | (20) |
| (P-55) | n-Butyl Methacrylate/Styrene Copolymer (70/30) | (20) |
| (P-56) | Poly(N-sec-butylacrylamide) | 117 |
| (P-57) | Poly(N-tert-butylacrylamide) | 128 |
| (P-58) | Diacetoneacrylamide/Methyl Methacrylate Copolymer (62/38) | (60, 105) |
| (P-59) | Polycyclohexyl Methacrylate/Methyl Methacrylate Copolymer (60/40) | (104, 105) |
| (P-60) | N-tert-Butylacrylamide/Methyl Methacrylate Copolymer (40/60) | (128, 105) |
| (P-61) | Poly(N-n-butylacrylamide) | 46 |
| (P-62) | Poly(tert-butyl methacrylate)/N-tert-Butylacrylamide Copolymer (50/50) | (118, 128) |
| (P-63) | tert-Butyl Methacrylate/Methyl Methacrylate Copolymer (70/30) | (118) |
| (P-64) | Poly(N-tert-butylmethacrylamide) | 160 |
| (P-65) | N-tert-Butylacrylamide/Methyl Methacrylate Copolymer (60/40) | (128, 105) |
| (P-66) | Methyl Methacrylate/Acrylonitrile Copolymer (70/30) | (105) |
| (P-67) | Methyl Methacrylate/Vinyl Methyl Ketone Copolymer (38/62) | (105, —) |
| (P-68) | Methyl Methacrylate/Styrene Copolymer (75/25) | (105) |
| (P-69) | Methyl Methacrylate/Hexyl Methacrylate Copolymer (70/30) | (105) |
| (P-70) | Poly(benzyl acrylate) | 6 |
| (P-71) | Poly(4-biphenyl acrylate) | 110 |
| (P-72) | Poly(4-butoxycarbonylphenyl acrylate) | 13 |
| (P-73) | Poly(sec-butyl acrylate) | −22 |
| (P-74) | Poly(tert-butyl acrylate) | 43 |
| (P-75) | Poly[3-chloro-2,2-bis(chloromethyl)-propyl acrylate] | 46 |
| (P-76) | Poly(2-chlorophenyl acrylate) | 53 |
| (P-77) | Poly(4-chlorophenyl acrylate) | 58 |
| (P-78) | Poly(pentachlorophenyl acrylate) | 147 |
| (P-79) | Poly(4-cyanobenzyl acrylate) | 44 |
| (P-80) | Poly(cyanoethyl acrylate) | 4 |
| (P-81) | Poly(4-cyanophenyl acrylate) | 90 |
| (P-82) | Poly(4-cyano-3-thiabutyl acrylate) | −24 |
| (P-83) | Poly(cyclohexyl acrylate) | 19 |
| (P-84) | Poly(2-ethoxycarbonylphenyl acrylate) | 30 |
| (P-85) | Poly(3-ethoxycarbonylphenyl acrylate) | 24 |
| (P-86) | Poly(4-ethoxycarbonylphenyl acrylate) | 37 |
| (P-87) | Poly(2-ethoxyethyl acrylate) | −50 |
| (P-88) | Poly(3-ethoxypropyl acrylate) | −55 |
| (P-89) | Poly(1H,1H,5H-octafluoropentyl acrylate) | −35 |
| (P-90) | Poly(heptyl acrylate) | −60 |
| (P-91) | Poly(hexadecyl acrylate) | 35 |
| (P-92) | Poly(hexyl acrylate) | −57 |
| (P-93) | Poly(isobutyl acrylate) | −24 |
| (P-94) | Poly(isopropyl acrylate) | −5 |
| (P-95) | Poly(3-methoxybutyl acrylate) | −56 |
| (P-96) | Poly(2-methoxycarbonylphenyl acrylate) | 46 |
| (P-97) | Poly(3-methoxycarbonylphenyl acrylate) | 38 |
| (P-98) | Poly(4-methoxycarbonylphenyl acrylate) | 67 |
| (P-99) | Poly(2-methoxyethyl acrylate) | −50 |
| (P-100) | Poly(4-methoxyphenyl acrylate) | 51 |
| (P-101) | Poly(3-methoxypropyl acrylate) | −75 |
| (P-102) | Poly(3,5-dimethyladamantyl acrylate) | 106 |
| (P-103) | poly(3-dimethylaminophenyl acrylate) | 47 |
| (P-104) | Polyvinyl tert-Butyrate | 86 |
| (P-105) | Poly(2-methylbutyl acrylate) | −32 |

-continued

| No. | Name of Polymer | Tg (°C.) |
|---|---|---|
| (P-106) | Poly(3-methylbutyl acrylate) | −45 |
| (P-107) | Poly(1,3-dimethylbutyl acrylate) | −15 |
| (P-108) | Poly(2-methylpentyl acrylate) | −38 |
| (P-109) | Poly(2-naphthyl acrylate) | 85 |
| (P-110) | Poly(phenyl acrylate) | 57 |
| (P-111) | Poly(propyl acrylate) | −37 |
| (P-112) | Poly(m-tolyl acrylate) | 25 |
| (P-113) | Poly(o-tolyl acrylate) | 52 |
| (P-114) | Poly(p-tolyl acrylate) | 43 |
| (P-115) | Poly(N,N-dibutylacrylamide) | 60 |
| (P-116) | Poly(isohexylacrylamide) | 71 |
| (P-117) | Poly(isooctylacrylamide) | 66 |
| (P-118) | Poly(N-methyl-N-phenylacrylamide) | 180 |
| (P-119) | Poly(adamantyl methacrylate) | 141 |
| (P-120) | Poly(benzyl methacrylate) | 54 |
| (P-121) | Poly(2-bromoethyl methacrylate) | 52 |
| (P-122) | Poly(2-N-tert-butylaminoethyl methacrylate) | 33 |
| (P-123) | Poly(sec-butyl methacrylate) | 60 |
| (P-124) | Poly(tert-butyl methacrylate) | 118 |
| (P-125) | Poly(2-chloroethyl methacrylate) | 92 |
| (P-126) | Poly(2-cyanoethyl methacrylate) | 91 |
| (P-127) | Poly(2-cyanomethylphenyl methacrylate) | 128 |
| (P-128) | Poly(4-cyanophenyl methacrylate) | 155 |
| (P-129) | Poly(cyclohexyl methacrylate) | 104 |
| (P-130) | Poly(dodecyl methacrylate) | −65 |
| (P-131) | Poly(diethylaminoethyl methacrylate) | −20 |
| (P-132) | Poly(2-ethylsulfinylethyl methacrylate) | 25 |
| (P-133) | Poly(hexadecyl methacrylate) | 15 |
| (P-134) | Poly(hexyl methacrylate) | −5 |
| (P-135) | Poly(2-hydroxypropyl methacrylate) | 76 |
| (P-136) | Poly(4-methoxycarbonylphenyl methacrylate) | 106 |
| (P-137) | Poly(3,5-dimethyladamantyl methacrylate) | 196 |
| (P-138) | Poly(dimethylaminoethyl-methacrylate) | 20 |
| (P-139) | Poly(3,3-dimethylbutyl methacrylate) | 45 |
| (P-140) | Poly(3,3-dimethyl-2-butyl methacrylate) | 108 |
| (P-141) | Poly(3,5,5-trimethylhexyl methacrylate) | 1 |
| (P-142) | Poly(octadecyl methacrylate) | −100 |
| (P-143) | Poly(tetradecyl methacrylate) | 80 |
| (P-144) | Poly(4-butoxycarbonylphenyl methacrylamide) | 128 |
| (P-145) | Poly(4-carboxyphenyl methacrylamide) | 200 |
| (P-146) | Poly(4-ethoxycarbonylphenyl methacrylamide) | 168 |
| (P-147) | Poly(4-methoxycarbonylphenyl methacrylate) | 180 |
| (P-148) | Poly(butyl butoxycarbonyl methacrylate) | 25 |
| (P-149) | Poly(butyl chloroacrylate) | 57 |
| (P-150) | Poly(butyl cyanoacrylate) | 85 |
| (P-151) | Poly(cyclohexyl chloroacrylate) | 114 |
| (P-152) | Poly(ethyl chloroacrylate) | 93 |
| (P-153) | Poly(ethyl ethoxycarbonyl methacrylate) | 52 |
| (P-154) | Poly(ethyl ethacrylate) | 27 |
| (P-155) | Poly(ethyl fluoromethacrylate) | 43 |
| (P-156) | Poly(hexyl hexyloxycarbonyl methacrylate) | −4 |
| (P-157) | Poly(isobutyl chloroacrylate) | 90 |
| (P-158) | Poly(isopropyl chloroacrylate) | 90 |

Note: The value parenthesized in the above means the glass transition point of a homopolymer composed of the acid-free monomer of the invention which accounts for 35 mol % or more of the polymer.

Next, the nondiffusible oil-soluble couplers for use in the present invention will be explained in detail hereunder.

The term "nondiffusible oil-soluble couplers" as used herein means those which are soluble in the above-mentioned coupler solvents and which are nondiffusible in photographic light-sensitive materials.

In accordance with the present invention, the coupler is incorporated into the silver halide emulsion layer of the photographic material generally in an amount of from 0.01 to 2 mols, preferably from 0.1 to 1.0 mol, per mol of the silver halide.

The epoxy compound of the invention is incorporated generally in an amount of from 5% by weight to 300% by weight, preferably from 10% by weight to 100% by weight, of the yellow coupler.

The oil-soluble polymer of the invention is incorporated generally in an amount of from 10% by weight to 300% by weight, preferably from 20% by weight to 150% by weight, of the yellow coupler.

When the epoxy compound and the oil-soluble polymer are applied to the yellow coupler in accordance with the present invention, the high boiling point organic solvent mentioned below may be used or may not be used. If the solvent is used, the amount of the solvent may be any desired amount.

Magenta couplers which may be used in the present invention are represented by the following formulae (M-I) and (M-II):

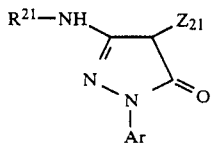

(M-I)

wherein $R^{21}$ represents an alkyl group, an aryl group, an acyl group or a carbamoyl group; Ar represents a phenyl group or a phenyl group having one or more substituents selected from a halogen atom, an alkyl group, a cyano group, an alkoxy group, an alkoxycarbonyl group and an acylamino group; $Z_{21}$ represents hydrogen or a group releasable by a reaction with the oxidation product of an aromatic primary amine color developing agent.

In more detail, in the formula (M-1), the alkyl group for $R^{21}$ is preferably one having from 1 to 42 carbon atoms, which may be substituted by a halogen atom, an alkoxy group, an aryl group, an alkoxycarbonyl group, an aryloxycarbonyl group, an acylamido group, a sulfonamido group, a sulfamoyl group, a carbamoyl group, an aryloxy group, an alkylthio group, an arylthio group, a sulfonyl group, a cyano group, an acyloxy group, an aryloxy group or an imido group. The aryl group for $R^{21}$ is preferably one having from 6 to 46 carbon atoms, which may also have substituent(s) selected from those for the alkyl group. The acyl group for $R^{21}$ is preferably an aliphatic acyl group having from 2 to 32 carbon atoms or an aromatic acyl group having from 7 to 46 carbon atoms, which may also have substituent(s) selected from those for the alkyl group. The carbamoyl group for $R^{21}$ is preferably an aliphatic carbamoyl group having from 2 to 32 carbon atoms or an aromatic carbamoyl group having from 7 to 46 carbon atoms, which may also have substituent(s) selected from those for the alkyl group.

$Z_{21}$ represents hydrogen or a coupling-releasable group. Specific examples of the group include a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group or an N-heterocyclic group. The releasable groups may contain the aforesaid photographically useful groups.

In the formula (M-I), $R^{21}$, Ar or $Z_{21}$ may form a dimer or a higher polymer.

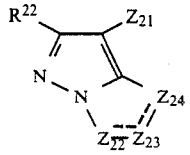

(M-II)

wherein $R^{22}$ represents hydrogen or a substituent; $Z_{21}$ represents a hydrogen atom or a group releasable by a reaction with the oxidation product of an aromatic primary amine developing agent; and $Z_{22}$, $Z_{23}$ and $Z_{24}$, which may be the same or different, each represents

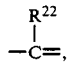

—N= or —NH—; provided that one of the $Z_{24}$–$Z_{23}$ bond and the $Z_{23}$–$Z_{22}$ bond is a double bond and the other is a single bond, and when the $Z_{22}$–$Z_{23}$ bond is a carbon-carbon double bond, this may be a part of an aromatic ring.

In more detail, in the formula (M-II), specific examples of $R^{22}$ include hydrogen, a halogen atom, an alkyl group, an aryl group, a heterocyclic group, a cyano group, an alkoxy group, an aryloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group and an aryloxycarbonyl group.

In the formula (M-II), $Z_{21}$ represents hydrogen or a coupling-releasable group, and $Z_{21}$ has the same definition in the formula (M-I). In the formula (M-II), $R^{22}$ and $Z_{21}$ may also form a dimer or a higher polymer.

Specific examples of the magenta couplers of the formulae (M-I) and (M-II) are described below, but the present invention is not to be construed as being limited thereto.

(M-1)
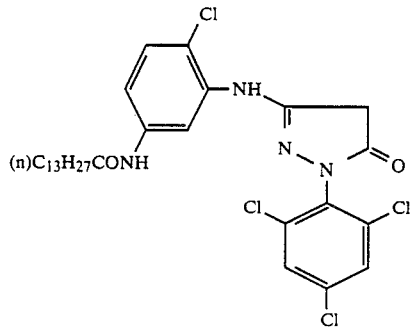
(M-2)
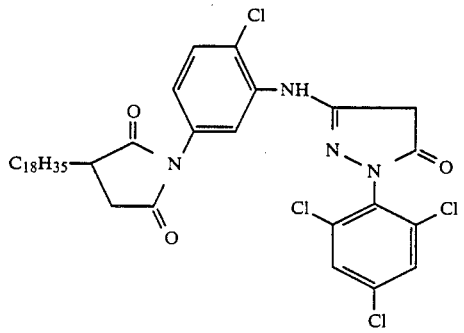
(M-3)
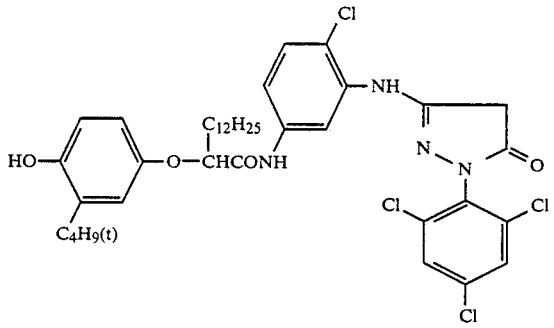
(M-4)
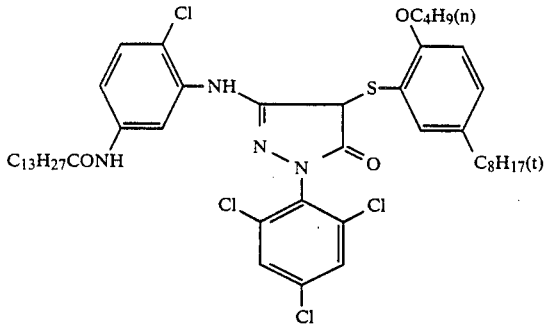
(M-5)
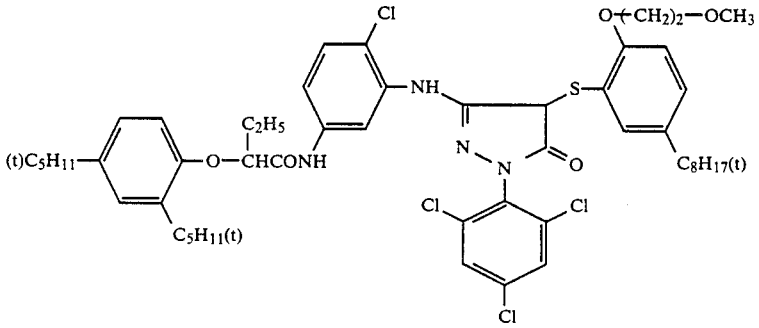

-continued
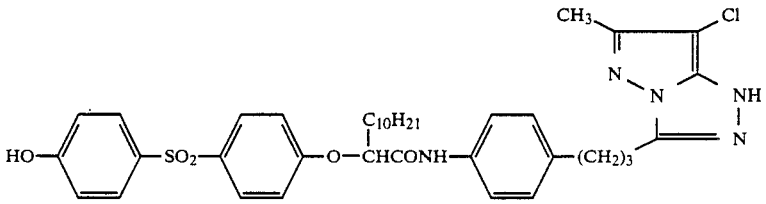
(M-6)
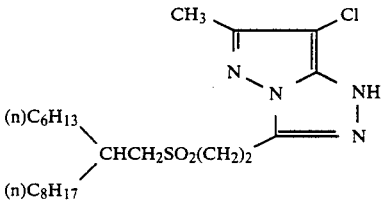
(M-7)
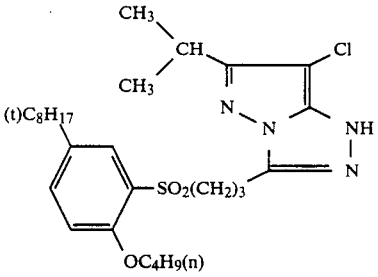
(M-8)
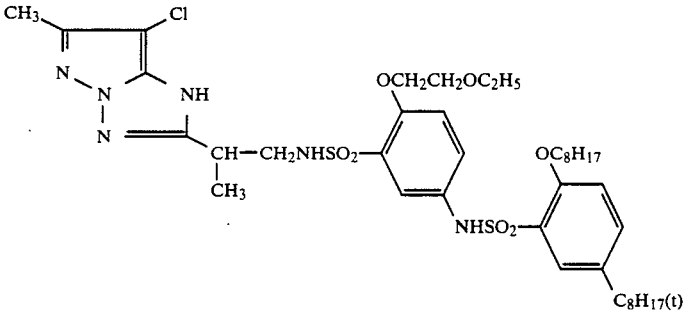
(M-9)
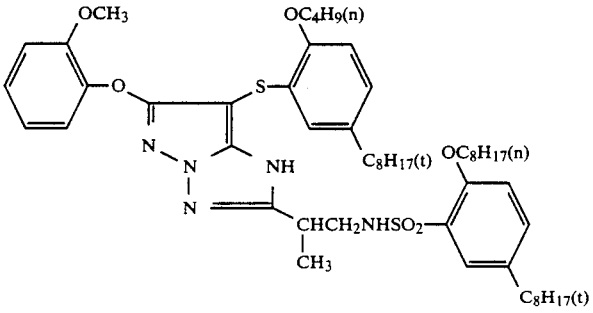
(M-10)

-continued (M-11)

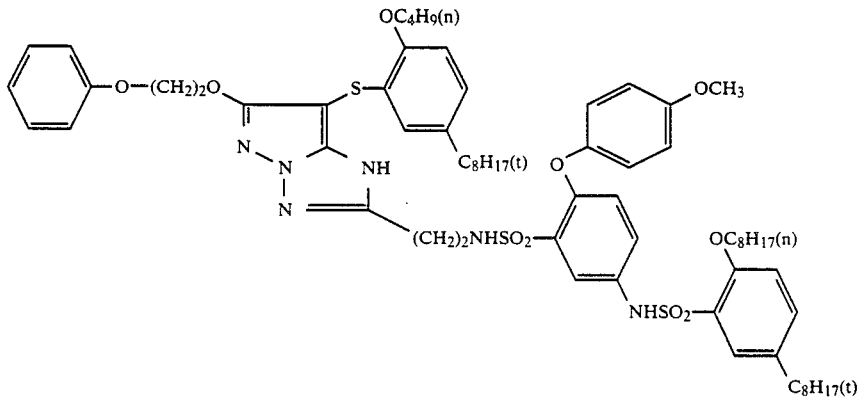

Cyan couplers which can be used in the present invention are preferably represented by the following formulae (C-I) and (C-II):

(C-I)

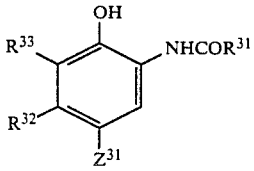

wherein $R^{31}$ represents an alkyl group, an aryl group, an amino group or a heterocyclic group; $R^{32}$ represents an acylamino group or an alkyl group; $R^{33}$ represents hydrogen, a halogen atom, an alkyl group or an alkoxy group; $R^{33}$ and $R^{32}$ may be linked to form a ring; and $Z^{31}$ represents hydrogen or a group releasable by a reaction with the oxidation product of an aromatic primary amine color developing agent.

In more detail, in the formula (C-I), the alkyl group for $R^{31}$ is preferably a linear, branched or cyclic alkyl group having from 1 to 32 carbon atoms; and the aryl group is preferably one having from 6 to 42 carbon atoms. When $R^{31}$ represents an amino group, this is an alkylamino group or an arylamino group, but is especially preferably an optionally substituted phenylamino group. The alkyl group, aryl group or phenylamino group for $R^{31}$ may have further substituent(s) selected from an alkyl group, an aryl group, an alkyloxy or aryloxy group, a carboxyl group, an alkylcarbonyl or arylcarbonyl group, an alkyloxycarbonyl or aryloxycarbonyl group, an acyloxy group, a sulfamoyl group, a carbamoyl group, a sulfonamido group, an acylamino group, an imido group, a sulfonyl group, a hydroxyl group, a cyano group and a halogen atom. When $R^{33}$ and $R^{32}$ are linked to form a ring, it is preferably selected from 5-membered to 7-membered rings, and an oxyindole ring, a 2-oxobenzimidazoline ring and a carbostyryl ring are especially preferred among them.

$Z^{31}$ represents a hydrogen atom or a coupling-releasable group. Examples of the coupling-releasable group include a halogen atom, an alkoxy group, an aryloxy group, an acyloxy group, a sulfonyloxy group, an amido group, an alkoxycarbonyloxy group, an aryloxycarbonyloxy group, an aliphatic, aromatic or heterocyclic thio group, an imido group and an N-heterocyclic group. The releasable groups may contain the aforesaid photographically useful groups.

In the formula (C-I), $R^{31}$, $R^{32}$ or $Z^{31}$ may form a dimer or a higher polymer.

(C-II)

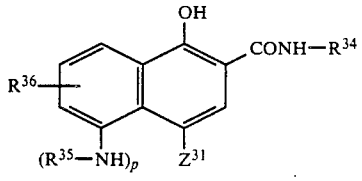

wherein $R^{34}$ represents an alkyl group, an aryl group or a heterocyclic group; $R^{35}$ represents an acyl group, a sulfonyl group, an alkoxycarbonyl group or an alkoxysulfonyl group; $R^{36}$ represents hydrogen, a halogen atom, an alkyl group, an alkoxy group, an aryloxy group, an amido group, an imido group, an alkylthio group, an arylthio group, a ureido group, an alkylsulfonyl group or an arylsulfonyl group; p is 0 or 1; and $Z^{31}$ represents hydrogen or a group releasable by a reaction with the oxidation product of an aromatic primary amine color developing agent.

In more detail, in the formula (C-II), the alkyl group for $R^{34}$ is preferably a linear, branched or cyclic alkyl group having from 1 to 32 carbon atoms; the aryl group therefor is preferably one having from 6 to 42 carbon atoms; and the heterocyclic group therefor is preferably a 4-membered to 7-membered ring containing at least one of oxygen, nitrogen and sulfur, and these groups may further have substituent(s) selected from those for the alkyl group for $R^{31}$ in the formula (C-I). $Z^{31}$ may be the same releasable group as $Z^{31}$ in the formula (C-I).

In the formula (C-II), $R^{34}$, $R^{35}$, $R^{36}$ or $Z^{31}$ may form a dimer or a higher polymer.

Specific examples of the cyan couplers of the aforesaid formulae (C-I) and (C-II) are disclosed below, but the present invention is not to be construed as being limited thereto.

(C-1)
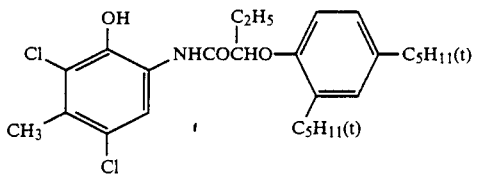
(C-2)
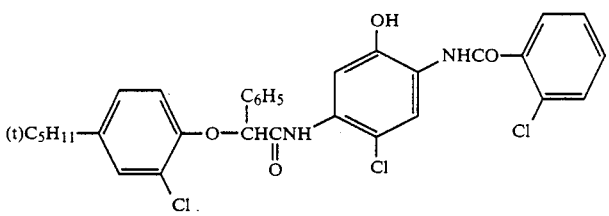
(C-3)
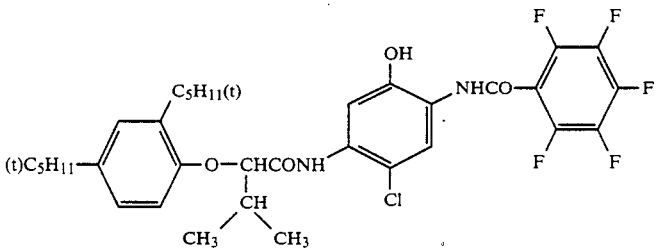
(C-4)
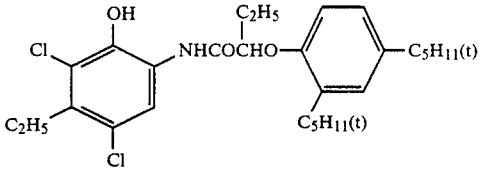
(C-5)
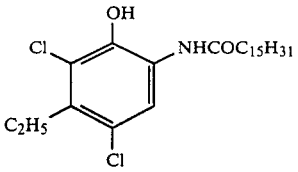
(C-6)
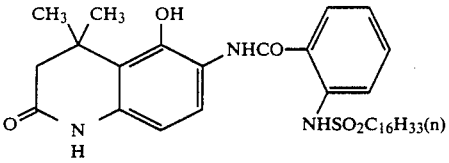
(C-7)
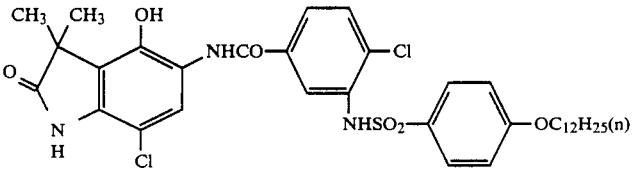
(C-8)
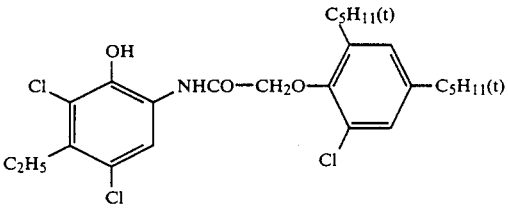

-continued (C-9)

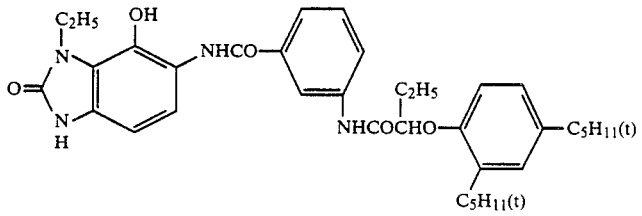

Any known image stabilizer can be used together with the compounds of the present invention, and, for example, the compounds described in the following patent publications can be used.

U.S. Pat. Nos. 3,432,300, 3,573,045, 3,574,627, 3,700,455, 3,764,337, 3,935,016, 4,254,216, 4,268,593, 4,430,425, 4,465,757, 4,465,765 and 4,518,679, British Patent 1,347,556, GB-A 2,066,975, JP-A-52-152225, JP-A-53-17729, JP-A-53,20327, JP-A-54-145530, JP-A-55-6321, JP-A-55-21004, JP-A-61-72246, JP-A-61-73152, JP-A-61-90155, JP-A-61-90156 and JP-A-61-145554.

Specifically, the following compounds are preferably used in the present invention, but the present invention is not to be construed as being limited thereto.

(F-1)

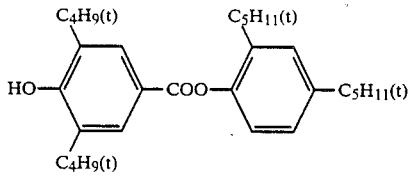

(F-2)

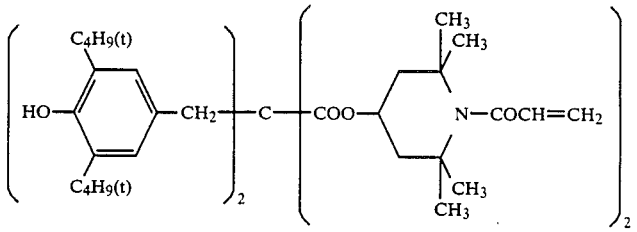

UV-Absorber Mixture (1:1:1:1 in mole ratio):

(F-3)

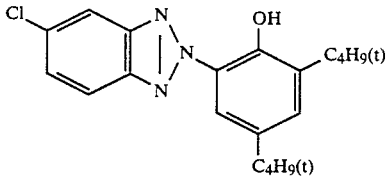

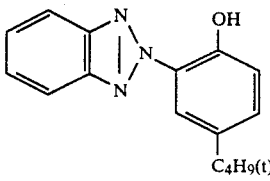

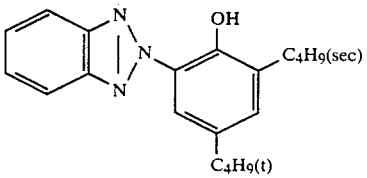

-continued
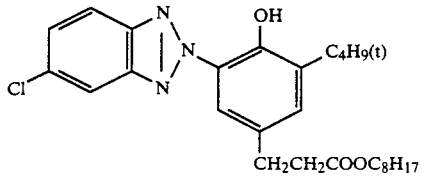
(F-4)
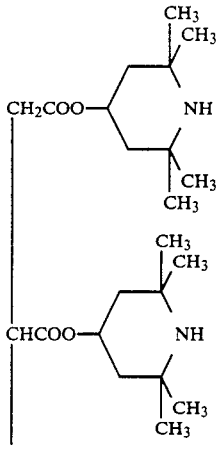
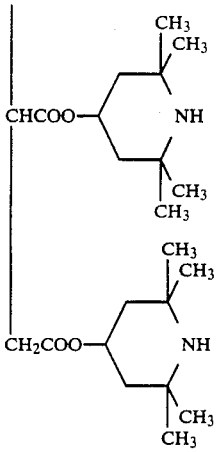
(F-5)
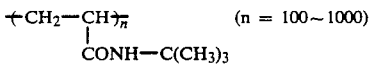
(F-6)
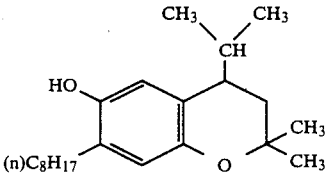
(F-7)
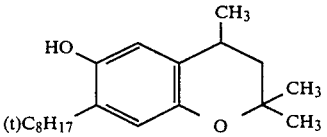

-continued
(F-8)
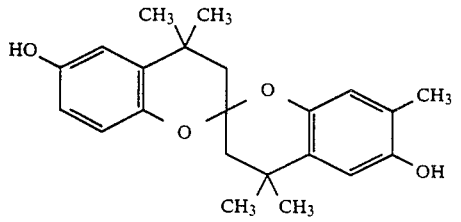
(F-9)
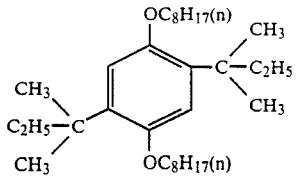
(F-10)
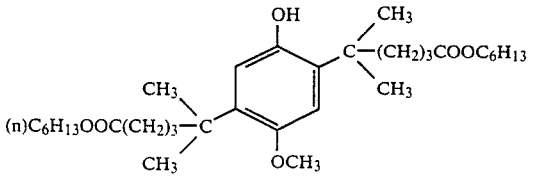
(F-11)
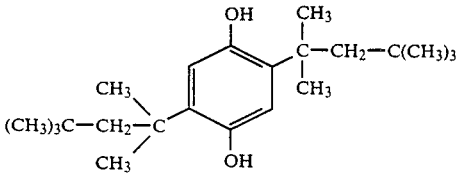
(F-12)
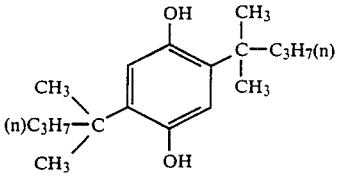
(F-13)
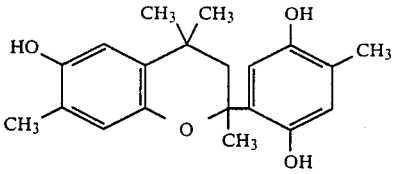
(F-14)
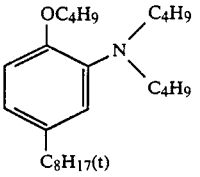
(F-15)
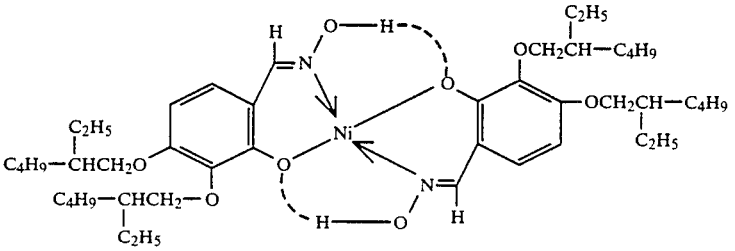

-continued (F-16)

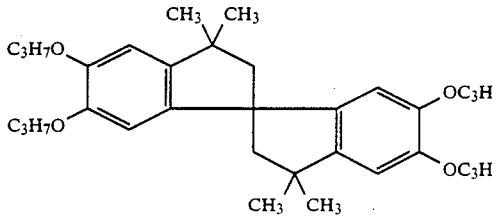

As the high boiling point organic solvents for use in the present invention, those having a boiling point of 160° C. or higher at normal pressure are preferred, and, for example, there are esters (e.g., phosphates, phthalates, fatty acid esters, benzoic acid esters), phenols, aliphatic alcohols, carboxylic acids, ethers, amides (e.g., fatty acid amides, benzoic acid amides, sulfonic acid amides, cyclic imides), fatty acid hydrocarbons, halogenated compounds and sulfonic acid derivatives. When couplers and other photographic additives are dissolved in such high boiling point organic solvents so as to incorporate them in photographic materials, low boiling point organic solvents having a boiling point of from 30° C. to 160° C., for example, lower esters (e.g., ethyl acetate, butyl acetate, ethyl propionate), as well as sec-butyl alcohol, methyl isobutyl ketone, cyclohexanone, β-ethoxyethyl acetate or dimethylformamide may optionally be blended with the high boiling point organic solvents, if desired. The resulting mixture may be dispersed in an aqueous hydrophilic colloid solution by emulsification and then blended with a photographic emulsion. In this step, only the low boiling point organic solvent, if used, may be removed by vacuum concentration or washing with water.

The amount of high boiling point organic solvent to be used is up to 20 parts, preferably from 0.2 to 3 parts, to 1 part of the coupler and other photographic additive to be dissolved therein.

Preferred examples of the high boiling point organic solvents for use in the present invention are mentioned below, but the present invention is not to be construed as being limited thereto.

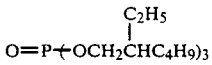

(O-1)

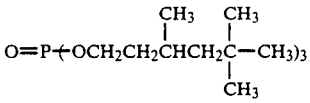

(O-2)

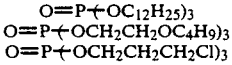

(O-3)

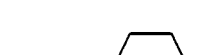

(O-4)

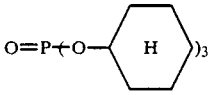

(O-5)

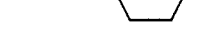

(O-6)

(O-7)

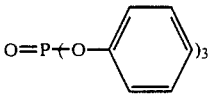

-continued (O-8)

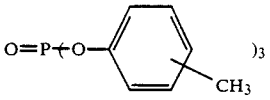

(m/p mixture)

(O-9)

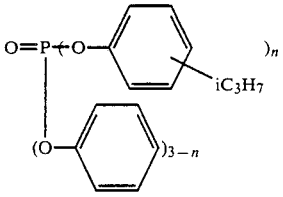

n = 1, 2, 3

(O-10)

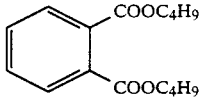

(O-11)

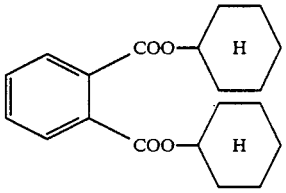

(O-12)

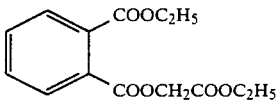

(O-13)

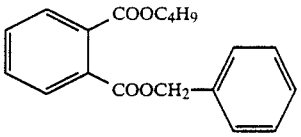

(O-14)

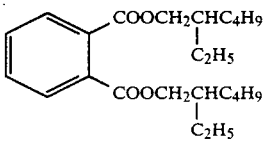

(O-15)

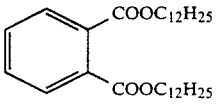

-continued
(O-16)
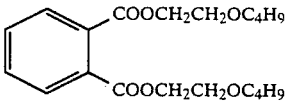
(O-17)
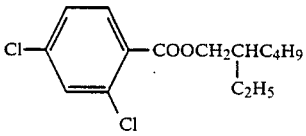
(O-18)
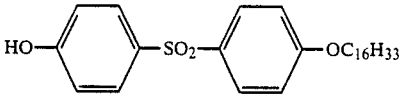
(O-19)
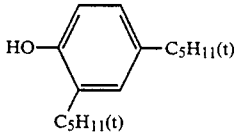
(O-20)
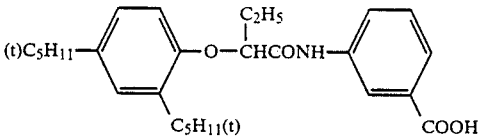
(O-21)
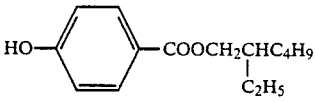
(O-22)
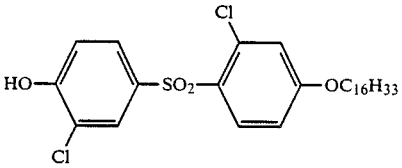
(O-23)
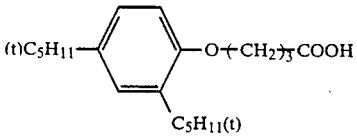
$C_8H_{17}CH{=}CH(CH_2)_7COOC_4H_9$ (O-24)
(O-25)
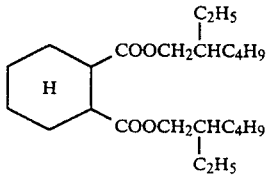
(O-26)
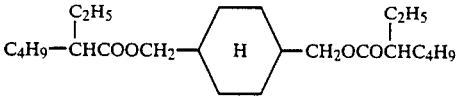
(O-27)
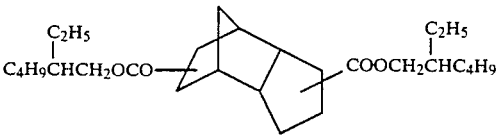
-continued
(O-28)
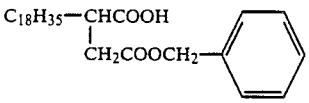
(O-29)
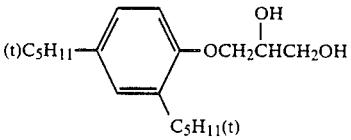
(O-30)
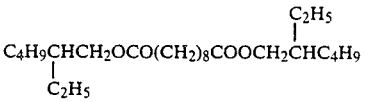
(O-31)
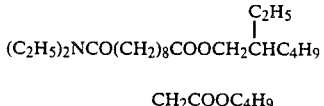
(O-32)
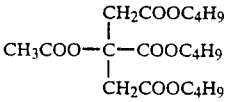
(O-33)
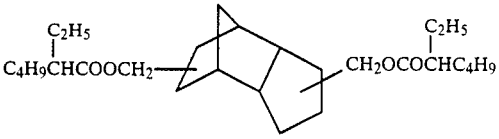
$C_nH_{2n+2}$ $n = 10 \sim 20$ (O-34)
(paraffin)
$CH_3COCH_2COOC_{12}H_{25}$ (O-35)
(O-36)
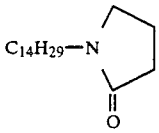
(O-37)
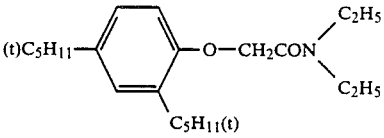
(O-38)
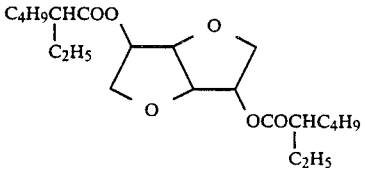
$C_{12}H_{18}Cl_8$ (O-39)
(chlorinated paraffin)
(O-40)
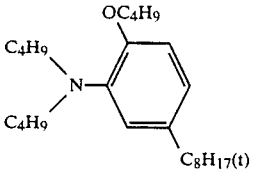

-continued

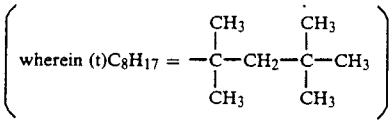

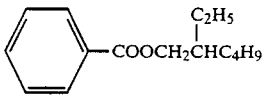

(O-41)

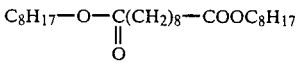

(O-42)

In accordance with the present invention, it is preferred to incorporate at least one ultraviolet absorber in the photographic material so as to more elevate the effect of the present invention.

An ultraviolet absorber may be added to any desired layer. Preferably, it is incorporated into a cyan coupler-containing layer or the adjacent layer. The compounds described in *Research Disclosure*, No. 17643, VIII-C can be used as the ultraviolet absorber in the present invention, and benzotriazole derivatives as represented by the following formula (XI) are preferred among them.

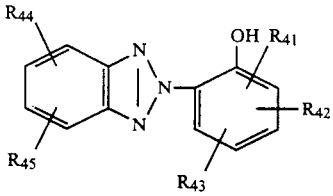

(XI)

In the formula $R_{41}$, $R_{42}$, $R_{43}$, $R_{44}$ and $R_{45}$, which may be the same or different, each represents hydrogen or a substituent. The substituents include substituents for the aliphatic group or aryl group as $R_1$ in formula (I). $R_{44}$ and $R_{45}$ may be linked to form a 5-membered or 6-membered aromatic ring composed of carbon atoms. The substituents and the aromatic ring may further have substituent(s).

The compounds of the formula (XI) can be used singly or in combination of two or more of them. Examples of specific compounds of ultraviolet absorbers for use in the present invention are as follows, but the present invention is not to be construed as being limited thereto. In the chemical structural formulae below, the skeleton

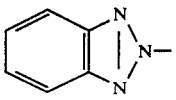

may have the structure

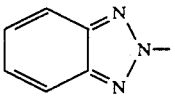

because of the resonance structure therebetween.

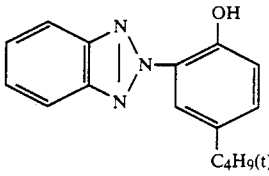

(UV-1)

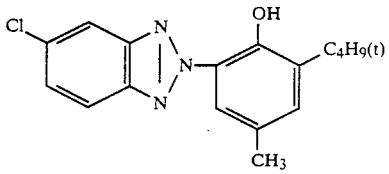

(UV-2)

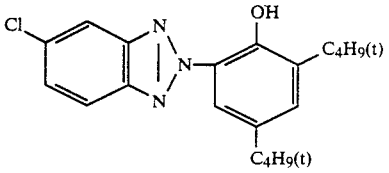

(UV-3)

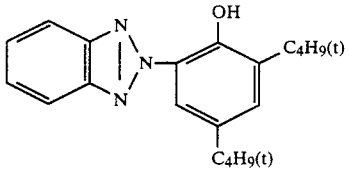

(UV-4)

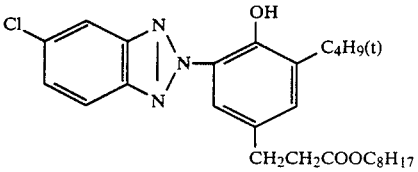

(UV-5)

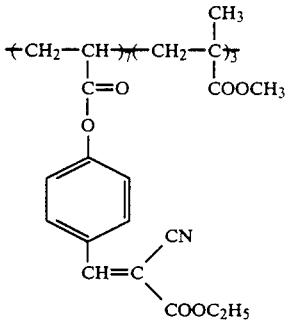

(UV-6)

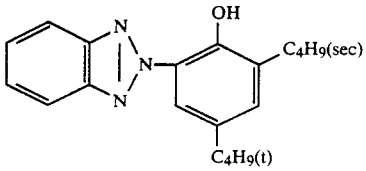

(UV-7)

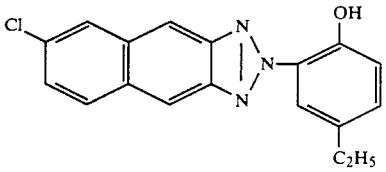

(UV-8)

-continued (UV-9)

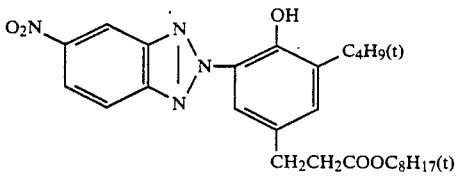

(UV-10)

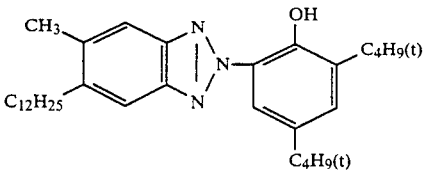

(UV-11)

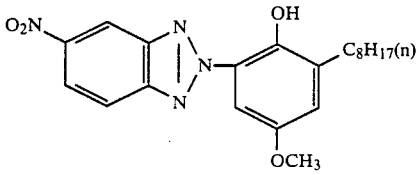

(UV-12)

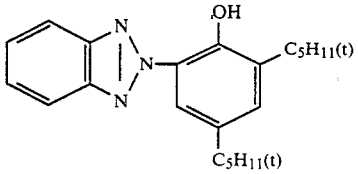

(UV-13)

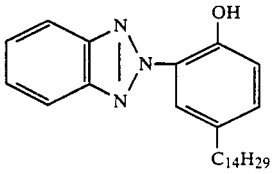

(UV-14)

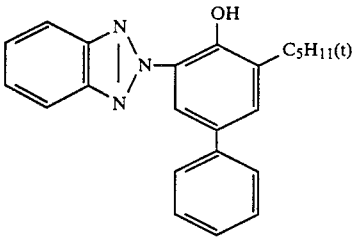

(UV-15)

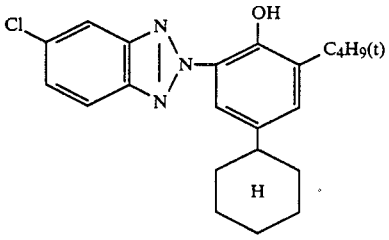

(UV-16)

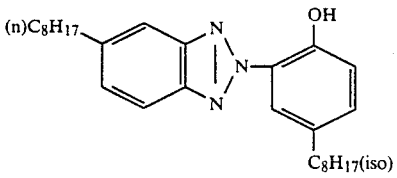

-continued (UV-17)

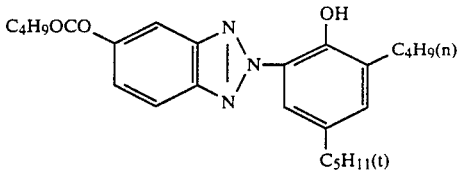

(UV-18)

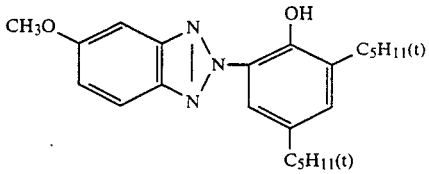

(UV-19)

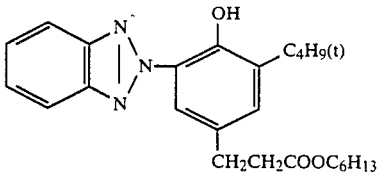

(UV-20)

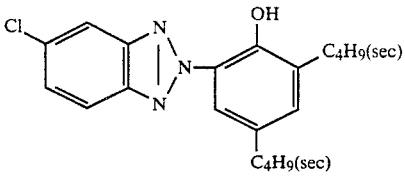

The method for the production of the compounds of formula (XI) and examples of other compounds are described in, for example, JP-B-44-29620 (the term "JP-B" as used herein means an "examined Japanese patent publication"), JP-A-50-151149, JP-A-54-95233, U.S. Pat. No. 3,766,205, European Patent 57160 and *Research Disclosure,* No. 22519 (1983). In addition, the macromolecular ultraviolet absorbers described i JP-A-58-111942 and 58-178351 (GB-A-218315), U.S. Pat. No. 4,455,368., JP-A-59-19945 and 59-23344 (GB-A-2127569) can also be used, and one example thereof is shown above as UV-6. A mixture comprising a low molecular ultraviolet absorber and a macromolecular ultraviolet absorber can also be used.

The aforesaid ultraviolet absorber can be dispersed in a hydrophilic colloid by emulsification in the same manner as for the incorporation of couplers therein. There is no particular limitation as to the amount of the high boiling point organic solvent and that of the ultraviolet absorber, but in general, the high boiling point organic solvent is used in an amount of up to 300% by weight of the ultraviolet absorber. It is preferred to use compounds which are liquid at room temperature, singly or in the form of a mixture of two or more of them.

When the ultraviolet absorber of the abovementioned formula (XI) is incorporated into the photographic material of the present invention, the storage stability, especially fastness to light, of the color image, especially the cyan color image, formed may remarkably be improved. The ultraviolet absorber may be emulsified together with a cyan coupler.

The amount of the ultraviolet absorber to be incorporated may be any amount sufficient to impart light stability to a cyan color image to be formed, but if it is too great, the nonexposed part (white background) of the color photographic material tends to yellow. Accordingly, the amount is generally preferably from $1\times10^{-4}$ mol/m$^2$ to $2\times10^{-3}$ mol/m$^2$, especially preferably from $5\times10^{-4}$ mol/m$^2$ to $1.5\times10^{-3}$ mol/m$^2$.

In order to improve the storage stability of color images formed, especially the yellow and magenta images, various kinds of organic or metal complex type antifading agents can be used in addition to or in combination with the above-mentioned compounds. As the organic antifading agents, there are hydroquinones, gallic acid derivatives, p-alkoxyphenols and p-hydroxyphenols. In addition, the color image stabilizers, stain inhibitors and antioxidants described in the patent publications referred to in *Research Disclosure,* Vol. 176, No. 17643 (December, 1978), VII, I to J may also be used. Examples of metal complex type antifading agents are described in *Research Disclosure,* Vol. 151, No. 15162 (November, 1976).

In order to improve the fastness of yellow images to heat and light, phenols, hydroquinones, hydroxychromans, hydroxycoumarans and hindered amines as well as alkyl ethers, silyl ethers and other various hydrolyzable precursor derivatives thereof can be used.

Various kinds of silver halides can be used in the silver halide emulsion layers of the color photographic materials of the present invention. For instance, any of silver chloride, silver bromide, silver chlorobromide, silver iodobromide or silver chloroiodobromide may be used. The crystal form, crystal structure, grain size and grain size distribution of the silver halide grains are not specifically limited, but a monodisperse emulsion having a grain size of from 0.2 to 1.2 μm and a grain size coefficient of variation of 0.15 or less is preferred. The crystal form of the silver halide grains may be either a normal crystal form or a twin plane crystal form. It may be hexahedral, octahedral or tetradecahedral, but it is preferably hexahedral or tetradecahedral. The grains may be tabular grains having a thickness of 0.5 μm or less, a diameter of 0.6 μm or less and a mean aspect ratio of 5 or more, which are, for example, described in *Research Disclosure,* Vol. 225, No. 22534 (January, 1983).

The crystal structure of the silver halide grains may be uniform throughout the grains, or may have different compositions in the inner part and the outer part of the grains, or may form a layered structure, or may contain two or more silver halides of different compositions as conjugated by an epitaxial junction.

As the support for use in the present invention, either a transparent support such as polyethylene terephthalate or cellulose triacetate or a reflective support mentioned below may be used. The reflective support is preferred for use in the present invention, which includes, for example, a baryta paper, a polyethylene-coated paper, a polypropylene synthetic paper as well as a transparent support (e.g., a glass plate, polyethylene terephthalate, cellulose triacetate, cellulose nitrate or polyester film, a polyamide film, a polycarbonate film, a polystyrene film, or a vinyl chloride resin film) coated with a reflective layer thereover or containing a reflecting material therein. The support can properly be selected in accordance with the use and the object of the photographic materials.

The respective blue-sensitive emulsion, green-sensitive emulsion and red-sensitive emulsion for use in the present invention are preferred to be spectrally sensitized with methine dyes or the like to have the respective color sensitivity. Dyes usable for the purpose include cyanine dyes, merocyanine dyes, complex cyanine dyes, complex merocyanine dyes, holopolar cyanine dyes, hemicyanine dyes, styryl dyes and hemioxonol dyes.

Particularly useful dyes are cyanine dyes, merocyanine dyes and complex merocyanine dyes.

The color photographic material of the present invention may have auxiliary layers such as a subbing layer, an interlayer and a protective layer in addition to the above-mentioned layers. If desired, a second ultraviolet absorbing layer can be provided between the red-sensitive silver halide emulsion layer and the green-sensitive silver halide emulsion layer. The above-mentioned ultraviolet absorber is preferably used in the ultraviolet absorbing layer, but any other known ultraviolet absorber may also be used therein.

As a binder or protective colloid for the photographic emulsion in the photographic material of the present invention, gelatin is advantageously used, but any other hydrophilic colloid can also be used.

For example, proteins such as gelatin derivatives, graft polymers of gelatin and other macromolecular substances, albumin or casein; cellulose derivatives such as hydroxyethyl cellulose, carboxymethyl cellulose or cellulose sulfates; saccharide derivatives such as sodium alginate or starch derivatives; as well as various synthetic hydrophilic polymer substances, e.g., homopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole or polyvinyl pyrazole can be used for the purpose.

As gelatin, a lime-processed gelatin and an acid-processed gelatin as well as the enzyme-processed gelatin described in *Bull. Soc. Sci. Phot. Jacan,* No. 16, page 30 (1966) may be used, and in addition, a hydrolyzed product of an enzyme-decomposed product of gelatin may be used.

The photographic material of the present invention can contain a brightening agent, e.g., stilbene, triazine, oxazole or coumarin compounds in the photographic emulsion layer or other hydrophilic colloid layers. The agent may be water-soluble, or alternatively, a water-insoluble brightening agent can be incorporated in the form of a dispersion thereof. Examples of brightening agents which can be used in the present invention are described in U.S. Pat. Nos. 2,632,701, 3,269,840 and 3,359,102, British Patents 852,075 and 1,319,763 and *Research Disclosure,* Vol. 176, No. 17643 (December, 1978), page 24, left-hand column, lines 9 to 36 (description of "Brighteners").

In the photographic material of the present invention, when a dye or ultraviolet absorber is incorporated into the hydrophilic colloid layer, it may be mordanted with a cationic polymer or the like. For example, the polymers described in British Patent 685,475, U.S. Pat. Nos. 2,675,316, 2,839,401, 2,882,156, 3,048,487, 3,184,309 and 3,445,231, German Patent Application (OLS) 1,914,362, JP-A-50-47624 and 50-71332 can be used for the purpose.

The photographic material of the present invention can contain, in addition to the above-mentioned ingredients, various other photographic additives which are known in this technical field, for example, a stabilizer, an antifoggant, a surfactant, other couplers than the couplers of the present invention, a filter dye, an antiirradiation dye and a developing agent. These additives can be incorporated into the material as needed, and examples of them are described in *Research Disclosure,* Vol. 176, No. 17643 (December, 1978).

Further, a substantially non-light-sensitive emulsion of fine silver halide grains (for example, a silver chloride, silver bromide or silver chlorobromide emulsion having a mean grain size of 0.20 μm or less) may also be added to the silver halide emulsion layer or other hydrophilic colloid layers, if desired.

The color developer for use in the present invention is preferably an aqueous alkaline solution consisting mainly of an aromatic primary amine color developing agent. As specific examples of the color developing agent for use in the present invention, there may be mentioned 4-amino-N,N-diethylaniline, 3-methyl-4-amino-N,N-diethylaniline, 4-amino-N-ethyl-N-β-hydroxyethyethylaniline, 3-methyl-4-amino-N-ethyl-β-hydroxyethylaniline, 3-methyl-4-amino-N-ethyl-N-β-methanesulfonamidoethylaniline and 4-amino-3-methyl-N-ethyl-N-β-methoxyethylaniline.

The color developer may contain a pH buffer such as alkali metal sulfites, carbonate, borates or phosphates, and a development inhibitor or an antifoggant such as bromides, iodides or organic antifoggants. In addition, it may also contain, if desired, a water softener; a preservative such as hydroxylamine; an organic solvent such as benzyl alcohol or diethylene glycol; a development accelerator such as polyethylene glycol, quaternary ammonium salts or amines; a dye-forming coupler, a competing coupler; a foggant such as sodium boronhydride; an auxiliary developing agent such as 1-phenyl-3-pyrazolidone; a tackifier; the polycarboxylic acid chelating agent described in U.S. Pat. No. 4,083,723; and the antioxidant described in German Patent Application (OLS) 2,622,950.

However, when benzyl alcohol is added to the color developer, the amount thereof is preferably 2.0 ml/liter or less, more preferably 0.5 m(/liter or less. Most preferably, no benzyl alcohol is added to the color developer. The color development time is preferably from 30 seconds to 2 minutes and 30 seconds, more preferably from 45 seconds to 2 minutes.

After color development, the photographic emulsion layer is generally bleached. The bleaching may be conducted simultaneously with fixation or separately therefrom. Bleaching agents include compounds of polyvalent metals such as iron(III), cobalt(III), chromium(IV) or copper(II), peracids, quinones, and nitroso compounds. For example, ferricyanides, dichromates, organic complexes of iron(III) or cobalt(III) (for example, complexes with an aminopolycarboxylic acid such as ethylenediaminetetraacetic acid, nitrilotriacetic acid or 1,3-diamino-2-propanoltetraacetic acid, or an organic acid such as citric acid, tartaric acid or malic acid); persulfates and permanganates; and nitrosophenol can be used. Among them, potassium ferricyanide, ethylenediaminetetraacetic acid iron(III) sodium complex and ethylenediaminetetraacetic acid iron(III) ammonium complex are especially useful. Ethylenediaminetetraacetic acid iron(III) complexes can also be used in a separate bleaching bath or in a combined bleach-fixing monobath.

After color development or bleach-fixation, the material may be rinsed in water. Color development can be carried out at any desired temperature of from 18° C. to 55° C. Preferably, it is carried out at 30° C. or higher, more preferably at 35° C. or higher. The time for development is from about 3 minutes and a half to about 1 minute, and shorter times are preferred. For continuous development, a replenisher is preferably added to the processing system. Desirably, the replenisher is added in an amount of at most 330 cc to 160 cc or less, preferably 100 cc or less, per $m^2$ of the material being processed.

Bleach-fixation can be conducted at any desired temperature of from 18° C. to 50° C., but 30° C. or higher is preferred. If the temperature is 35° C. or higher, the processing time may be 1 minute or less and the amount of the replenisher may be reduced. The time required for rinsing in water after color development or bleach-fixation is generally within 3 minutes, and the rinsing step can be carried out under a substantially water-free condition using a stabilizing bath.

The colored dyes are deteriorated and discolored not only by light, heat or variation of atmospheric temperature, but also by fungi during storage. Since cyan color images are especially apt to be deteriorated by fungi, it is preferred to use a fungicide. As examples of the fungicide for the purpose, there are the 2-thiazolylbenzimidazoles described in JP-A-57-157244. The fungicide may be incorporated into the photographic material or may be added thereto during the development step. If the fungicide is incorporated into the processing solution, it may be added to the photographic material being processed at any desired step.

The following examples are intended to illustrate the present invention but are not to be construed as limiting it in any way. Unless otherwise indicated, all parts, percents and ratios are by weight.

EXAMPLE 1

A multilayer color photographic paper (Sample (A)) was prepared by forming the layers having the compositions shown below on a paper support both surfaces of which were coated with polyethylene. The coating compositions for the layers were prepared as follows:

Coating Composition for First Layer:

27.2 cc of ethyl acetate and 14.0 cc of solvent (Solv-3) were added to 9.20 g of yellow coupler (ExY1), 9.70 g of yellow coupler (ExY2) and 4.4 g of color image stabilizer (Cpd-1) and dissolved, and the resulting solution was dispersed by emulsification in 185 cc of an aqueous 10 wt % gelatin solution containing 8 cc of 10 wt % sodium dodecylbenzenesulfonate. Separately, the following blue-sensitive sensitizing dye was added to a monodisperse cubic silver chlorobromide emulsion (silver bromide 80.0 mol %, coefficient of variation 0.10, mean grain size 1.1 μm) in an amount of $5.0\times10^{-4}$ mol per mol of silver. The emulsified dispersion prepared above was mixed with the aforesaid silver halide emulsion to prepare a coating composition for the first layer having the composition mentioned below. Coating compositions for the second layer to the seventh layer were also prepared by the same manner as in the first layer. As a gelatin hardening agent for each layer, 1-hydroxy-3,5-dichloro-s-triazine sodium salt was used.

The following spectral sensitizing dyes were used for the respective layers.

Blue-Sensitive Emulsion Layer:

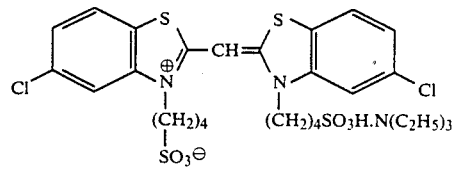

(amount added: $5.0\times10^{-4}$ mol per mol of silver halide)

-continued

Green-Sensitive Emulsion Layer:

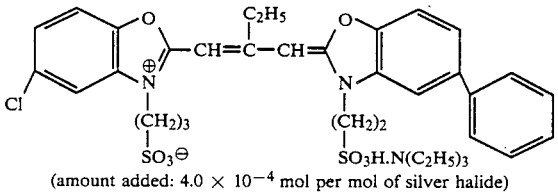

(amount added: $4.0 \times 10^{-4}$ mol per mol of silver halide)

and

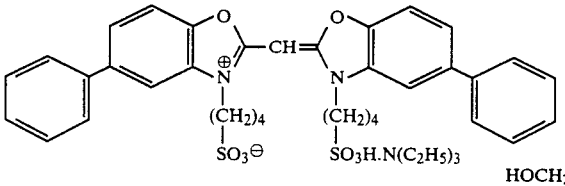

(amount added: $7.0 \times 10^{-5}$ mol per mol of silver halide)

Red-Sensitive Emulsion Layer:

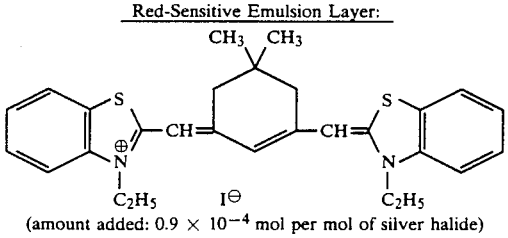

(amount added: $0.9 \times 10^{-4}$ mol per mol of silver halide)

The following compound was added, as a super-sensitizing agent, to the red-sensitive emulsion layer in an amount of $2.6 \times 10^{-3}$ mol per mol of silver halide.

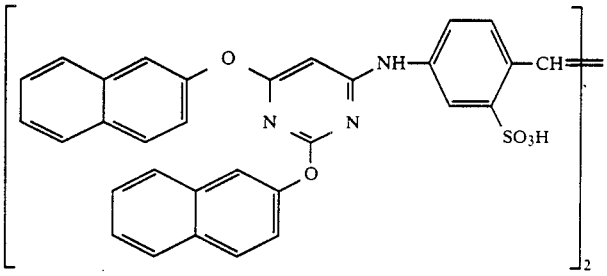

In addition, 1-(5-methylureidophenyl)-5-mercaptotetrazole was added to each of the blue-sensitive emulsion layer, green-sensitive emulsion layer and red-sensitive emulsion layer, in amounts of $4.0 \times 10^{-6}$ mol, $3.0 \times 10^{-5}$ mol and $1.0 \times 10^{-5}$ mol, respectively, per mol of silver halide.

Further, 4-hydroxy-6-methyl-1,3,3a,7-tetraazaindene was added to each of the blue-sensitive emulsion layer and green-sensitive emulsion layer in amounts of $1.2 \times 10^{-2}$ mol and $1.1 \times 10^{-2}$ mol, respectively, per mol of silver halide.

The following dyes were added to the silver halide color photographic material for antiirradiation.

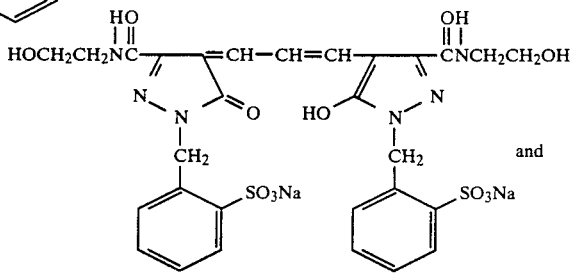

and

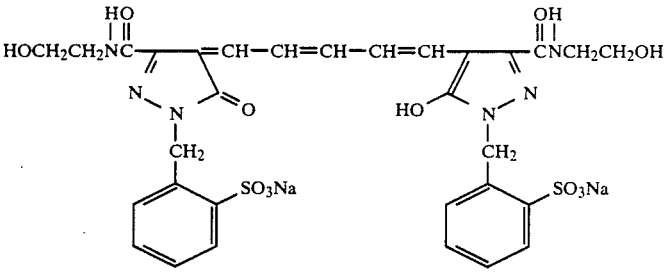

The compositions of the layers were as follows. The amount of each component is in units of g/m². The amount of the silver halide emulsion means the amount of silver coated.

Support:

Polyethylene-laminated paper (containing a white pigment (TiO) and a bluish dye (ultramarine) in the polyethylene in the side of the first layer)

| First Layer: Blue-Sensitive Layer | |
|---|---|
| Silver Halide Emulsion (Br: 80%, mean grain size: 1.1 μm, coefficient of variation: 0.10, cubic grains) | 0.26 |
| Gelatin | 1.83 |
| Yellow Coupler (ExY1) | 0.40 |

-continued

| | |
|---|---|
| Yellow Coupler (ExY2) | 0.42 |
| Solvent (Solv-1) | 0.64 |
| Color Image Stabilizer (Cpd-1) | 0.08 |
| Second Layer: Color Mixing Preventing Layer | |
| Gelatin | 0.99 |
| Color Mixing Preventing Agent (Cpd-2) | 0.08 |
| Third Layer: Green-Sensitive Layer | |
| Silver Halide Emulsion (Br: 80%, mean grain size: 0.43 μm, coefficient of variation: 0.10, cubic grains) | 0.16 |
| Gelatin | 1.79 |
| Magenta Coupler (ExM1) | 0.32 |
| Color Image Stabilizer (Cpd-1) | 0.10 |
| Color Image Stabilizer (Cpd-3) | 0.20 |
| Color Image Stabilizer (Cpd-4) | 0.05 |
| Solvent (Solv-2) | 0.65 |
| Fourth Layer: Ultraviolet Absorbing Layer | |
| Gelatin | 1.58 |
| Ultraviolet Absorber (UV-1) | 0.62 |
| Color Mixing Preventing Agent (Cpd-5) | 0.05 |
| Solvent (Solv-3) | 0.24 |
| Fifth Layer: Red-Sensitive Layer | |

-continued

| | |
|---|---|
| Silver Halide Emulsion (Br: 70%, mean grain size: 0.55 μm, coefficient of variation: 0.13, cubic grains) | 0.23 |
| Gelatin | 1.34 |
| Cyan Coupler (ExC) | 0.24 |
| Color Image Stabilizer (Cpd-6) | 0.17 |
| Polymer (Cpd-7) | 0.30 |
| Solvent (Solv-4) | 0.23 |
| Sixth Layer: Ultraviolet Absorbing Layer | |
| Gelatin | 0.53 |
| Ultraviolet Absorber (UV-1) | 0.21 |
| Solvent (Solv-3) | 0.08 |
| Seventh Layer: Protective Layer | |
| Gelatin | 1.33 |
| Acryl-Modified Copolymer of Polyvinyl Alcohol (modification degree of 17%) | 0.17 |
| Liquid Paraffin | 0.03 |

Note: Mean grain size is the mean value of the edge length of grains. Coefficient of variation was represented by the ratio (s/d) of the statistical standard deviation (s) to the mean grain diameter (d).

The compounds used in Example 1 had the following structural formulae.

Yellow Coupler (ExY1):

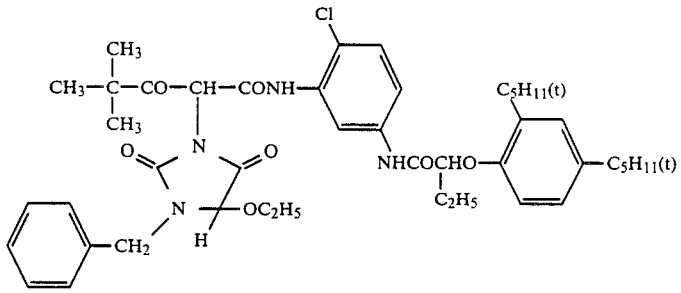

Yellow Coupler (ExY2):

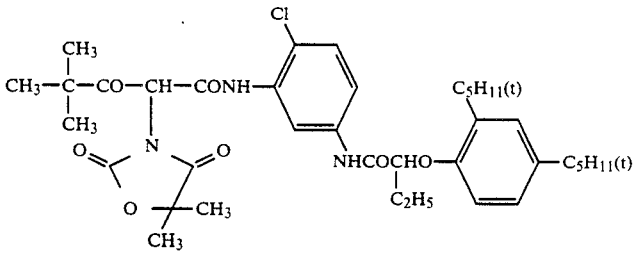

Magenta Coupler (ExM1):

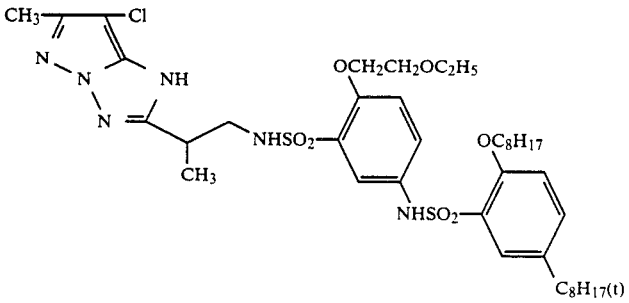

Cyan Coupler (ExC):

-continued
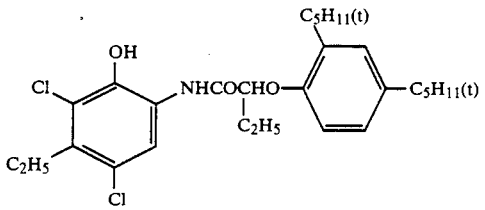
Color Image Stabilizer (Cpd-1):
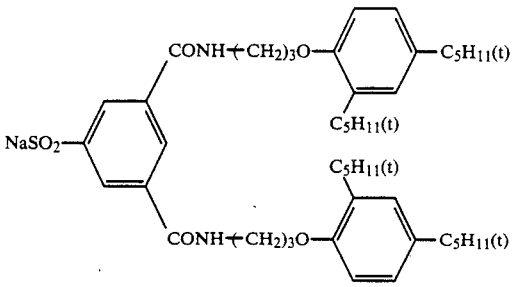
Color Mixing Preventing Agent (Cpd-2):
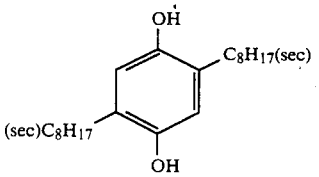
Color Image Stabilizer (Cpd-3):
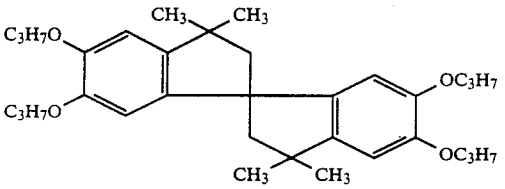
Color Image Stabilizer (Cpd-4):
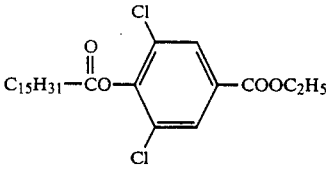
Color Mixing Preventing Agent (Cpd-5):
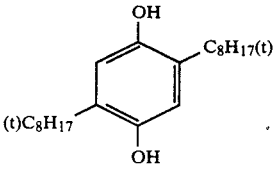
Color Image Stabilizer (Cpd-6):
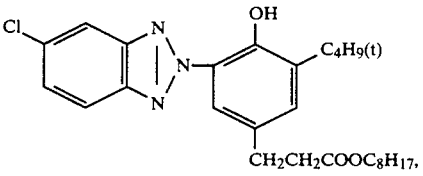

-continued
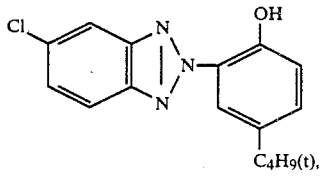
and
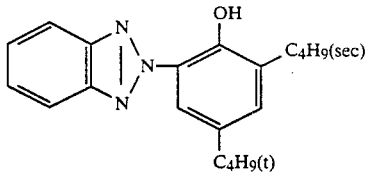
Mixture of 5/8/9 (by weight)
Polymer (Cpd-7):
$$\left(CH_2-\underset{\substack{|\\ CONHC_4H_9(t)}}{CH}\right)_n$$
Mean molecular weight: 50,000
Ultraviolet Absorber (UV-1):
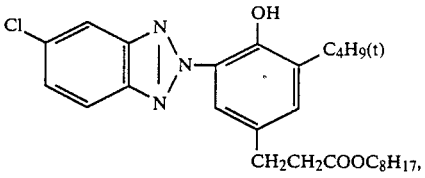
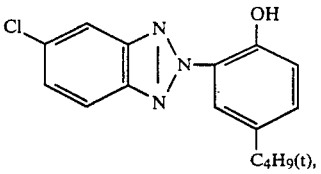
and
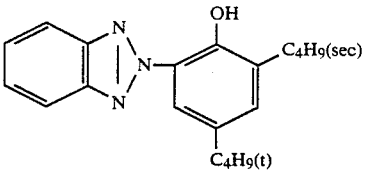
Mixture of 2/9/8 (by weight)
Solvent (Solv-1):
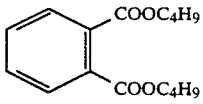
Solvent (Solv-2):
$$O{=}P\left(OCH_2\overset{\substack{C_2H_5\\ |}}{C}HC_4H_9\right)_3$$
and -continued

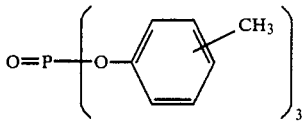

Mixture of 2/1 (by volume)

Solvent (Solv-3):

$O{=}P{+}O{-}C_9H_{19}(iso))_3$

Solvent (Solv-4):

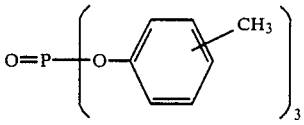

Solvent (Solv-5):

$C_8H_{17}OOC{+}CH_2{)}_8COOC_8H_{17}$

Next, color photographic papers (Samples (B) to (T)) were prepared in the same manner as the preparation of Sample (A) except that the epoxy compound of the invention and the polymer of the invention were added to the first layer as indicated in Table 1 below.

Each of the thus-prepared Samples (A) to (T) was sensitometrically exposed with a sensitometer (FWH Type, by Fuji Photo Film Co., Ltd.; color temperature of light source: 3,200° K) through blue, green and red filters. The exposure time was 1/10 second and the exposure value was 250 CMS.

After exposure, the samples were subjected to color development, bleach-fixation and rinsing in water as follows.

| Processing Step | Temperature (°C.) | Time |
|---|---|---|
| Color Development | 38 | 1 min 40 sec |
| Bleach-Fixation | 30 to 34 | 1 min 00 sec |
| Rinsing (1) | 30 to 34 | 20 sec |
| Rinsing (2) | 30 to 34 | 20 sec |
| Rinsing (3) | 30 to 34 | 20 sec |
| Drying | 70 to 80 | 50 sec |

(Rinsing was conducted by a three-tank countercurrent system from rinsing bath (3) through rinsing bath (2) to rinsing bath (1).)

The compositions of the respective processing solutions were as follows.

| | |
|---|---|
| Color Developer: | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Brightening Agent (WHITEX 4B, by Sumitomo Kagaku) | 1.0 g |
| Water to make | 1,000 ml |
| pH (25° C.) | 10.20 |
| Bleach-Fixing Solution: | |
| Water | 400 ml |
| Ammonium Thiosulfate (70 wt %) | 200 ml |
| Sodium Sulfite | 20 g |
| Ammonium Ethylenediaminetetraacetic Acid Iron (III) | 60 g |
| Ethylenediaminetetraacetic Acid Disodium Salt | 10 g |
| Water to make | 1,000 ml |
| pH (25° C.) | 7.0 |

Rinsing Solution:

Ion Exchanged Water (content of Ca and Mg: each 3 ppm or less)

TABLE 1

| | First Layer | | | | |
|---|---|---|---|---|---|
| Sample | Yellow Coupler | Epoxy Compound (g/g of coupler) (g/g) | Polymer (g/g of coupler) (g/g) | Solvent (g/g of coupler) (g/g) | Remarks |
| A | ExY-1/ExY-2 | — | — | Solv-3 0.77 | Comparison |
| B | " | — | P-7 0.30 | Solv-3 0.77 | " |
| C | " | — | — | Solv-5 0.42 | " |
| D | " | — | P-57 0.30 | Solv-5 0.42 | |
| E | " | Compound (II-1) 0.77 | — | — | " |
| F | " | Compound (II-1) 0.35 | — | Solv-5 0.42 | " |

TABLE 1-continued

| Sample | First Layer: Yellow Coupler | Epoxy Compound (g/g of coupler) (g/g) | Polymer (g/g of coupler) (g/g) | Solvent (g/g of coupler) (g/g) | Remarks |
|---|---|---|---|---|---|
| G | " | Compound (II-5) 0.77 | — | — | " |
| H | " | Compound (II-9) 0.77 | — | — | " |
| I | I-12 | Compound (II-12) 0.77 | — | — | " |
| J | ExY-1/ExY-2 | Compound (II-1) 0.77 | P-1 0.30 | — | Invention |
| K | ExY-1/ExY-2 | Compound (II-1) 0.77 | P-3 0.30 | Solv-5 0.42 | Invention |
| L | " | Compound (II-1) 0.77 | P-7 0.30 | — | " |
| M | " | Compound (II-1) 0.77 | P-57 0.30 | — | " |
| N | " | Compound (II-1) 0.77 | P-90 0.30 | — | " |
| O | " | Compound (II-1) 0.77 | P-129 0.30 | — | " |
| P | " | Compound (II-5) 0.77 | P-1 0.30 | — | " |
| Q | " | Compound (II-5) 0.77 | P-3 0.30 | — | " |
| R | " | Compound (II-9) 0.77 | P-57 0.30 | — | " |
| S | " | Compound (II-20) 0.77 | P-57 0.30 | — | " |
| T | I-12 | Compound (II-12) 0.77 | P-57 0.30 | — | " |

Each of the samples thus having colored images was examined with respect to the light fastness and the heat fastness in accordance with the following methods.

(i) Light Fastness:

Samples were irradiated with a xenon fade-meter (about 80,000 lux) for 12 days.

(ii) Heat Fastness:

Samples were incubated under conditions of 80° C. and 70% RH for 24 days.

The fastness of the color image was represented by the percentage (%) of the density (D) after test (irradiation or incubation) compared to the initial density ($D_0=1.5$).

The results obtained are shown in Table 2 below.

In the evaluation, the yellow density caused by the stain formed by the test was subtracted from the density (D).

TABLE 2

| Sample | Light Fastness (%) | Heat Fastness (%) | Remarks |
|---|---|---|---|
| A | 68 | 75 | Comparison |
| B | 84 | 76 | " |
| C | 71 | 73 | " |
| D | 89 | 74 | " |
| E | 62 | 88 | " |
| F | 61 | 83 | " |
| G | 64 | 90 | " |
| H | 63 | 88 | " |
| I | 45 | 74 | " |
| J | 85 | 90 | Invention |
| K | 91 | 89 | " |
| L | 83 | 88 | " |
| M | 94 | 92 | " |
| N | 80 | 88 | " |
| 0 | 90 | 90 | " |

TABLE 2-continued

| Sample | Light Fastness (%) | Heat Fastness (%) | Remarks |
|---|---|---|---|
| P | 86 | 91 | " |
| Q | 91 | 91 | " |
| R | 94 | 93 | " |
| S | 93 | 92 | " |
| T | 83 | 84 | " |

As is clear from the results in Table 2, the light fastness and heat fastness of images formed were extremely improved by the combination of the epoxy compound of the invention and the polymer of the invention. With respect to light fastness, the samples were additionally subjected to another test with a fluorescent lamp. As a result, the improvement of the light fastness of the samples of the invention over that of the comparative samples was more remarkable than in the previous xenon lamp test.

Using other samples prepared by changing the magenta coupler in the third layer to one of the above Compounds (M-1) to (M-11) and the cyan coupler in the fifth layer to one of the above Compounds (C-1) to (C-9), the same experiments were repeated, and the same results were obtained.

Next, other photographic papers (Samples (U) and (V)) were prepared in the same manner as the preparation of Samples (A) and (B), respectively, except that the respective color-sensitive emulsions were replaced by the following cubic silver chlorobromide emulsions (silver bromide content: 0.4 to 1 mol %) and the spectral sensitizing dyes for the blue-sensitive layer, green-sensitive layer and red-sensitive layer were replaced by those described below.

Cubic Silver Chlorobromide Emulsion:

| | Mean Grain | Coefficient | Silver Bromide |
|---|---|---|---|

-continued

| | Size (μm) | of Variation | Content (mol %) |
|---|---|---|---|
| Blue-Sensitive Layer | 0.97 | 0.13 | 0.7 |
| Green-Sensitive Layer | 0.39 | 0.12 | 0.4 |
| Red-Sensitive Layer | 0.48 | 0.09 | 1.0 |

Sensitizing Dye:

Blue-Sensitive Emulsion Layer:

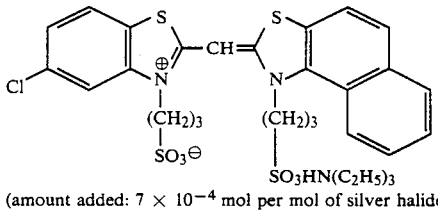

(amount added: $7 \times 10^{-4}$ mol per mol of silver halide)

Green-Sensitive Emulsion Layer:

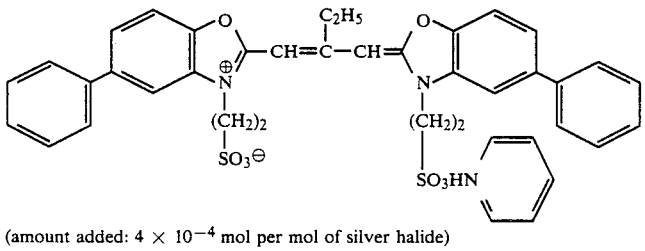

(amount added: $4 \times 10^{-4}$ mol per mol of silver halide)

Red-Sensitive Emulsion Layer:

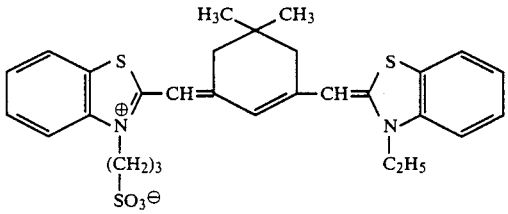

(amount added: $2 \times 10^{-4}$ mol per mol of silver halide

Samples (U) and (V) thus prepared were exposed in the same manner as in Samples (A) and (B) and then subjected to color development, bleach-fixation and stabilization in accordance with the following procedure.

| Processing Step | Temperature (°C.) | Time (sec) |
|---|---|---|
| Color Development | 35 | 45 |
| Bleach-Fixation | 30 to 36 | 45 |
| Stabilization (1) | 30 to 37 | 20 |
| Stabilization (2) | 30 to 37 | 20 |
| Stabilization (3) | 30 to 37 | 20 |
| Stabilization (4) | 30 to 37 | 30 |
| Drying | 70 to 85 | 60 |

(The stabilization was conducted by a four-tank countercurrent system from stabilization bath (4) through stabilization baths (2) and (3) to stabilization bath (1).)

The compositions of the respective processing solutions were as follows:

| | |
|---|---|
| Color Developer: | |
| Water | 800 ml |
| Ethylenediaminetetraacetic Acid | 2.0 g |
| Triethanolamine | 8.0 g |

-continued

| | |
|---|---|
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Brightening Agent (4,4'-diaminostilbene type) | 2.0 g |
| Water to make | 1,000 ml |
| pH (25° C.) | 10.10 |
| Bleach-Fixing Solution: | |
| Water | 400 ml |
| Ammonium Thiosulfate (70 wt %) | 100 ml |
| Sodium Sulfite | 18 g |
| Ammonium Ethylenediaminetetraacetic Acid Iron (III) | 55 g |
| Ethylenediaminetetraacetic Acid Disodium Salt | 3 g |
| Glacial Acetic Acid | 8 g |
| Water to make | 1,000 ml |
| pH (25° C.) | 5.5 |
| Stabilizing Solution: | |
| Formalin (37% aqueous solution) | 0.1 g |
| Formalin-Sulfurous Acid Adduct | 0.7 g |
| 5-Chloro-2-methyl-4-isothiazolin-3-one | 0.02 g |
| 2-Methyl-4-isothiazolin-3-one | 0.01 g |
| Copper Sulfate | 0.005 g |
| Water to make | 1,000 ml |

-continued

| | |
|---|---|
| pH (25° C.) | 4.0 |

The thus processed Samples (U) and (V) were examined by the same test as mentioned above, with respect to the light fastness and heat fastness of the color images formed. As a result, almost the same results as above were obtained.

EXAMPLE 2

A color photographic material was prepared by forming the first to twelfth layers having the compositions mentioned below on a paper support both surfaces of which were coated with a layer of polyethylene. Titanium white (3.8 g/m$^2$) as a white pigment and 0.1 g/m2 of ultramarine as a bluish dye were contained in the polyethylene for the side of the first layer.

The compositions of the layers were as follows. The amount of each component is in the units of g/m$^2$. The amount of the silver halide emulsion means the amount of silver coated.

| | |
|---|---|
| First Layer: Gelatin Layer | |
| Gelatin | 1.30 |
| Second Layer: Antihalation Layer | |
| Black Colloidal Silver | 0.10 |
| Gelatin | 0.70 |
| Third Layer: Low-Sensitive Red-Sensitive Emulsion Layer | |
| Silver Chlorobromide Emulsion EM1 Spectrally Sensitized with Red-Sensitizing Dyes (ExS-1, 2, 3, in equal mols) (silver chloride: 1 mol %, silver iodide: 4 mol %, mean grain size: 0.3 μm, size distribution: 10%, cubic core-iodine type core/shell grains) | 0.06 |
| Silver Iodobromide Emulsion EM2 Spectrally Sensitized with Red-Sensitizing Dyes (ExS-1, 2, 3, in equal mols) (silver iodide: 5 mol %, mean grain size: 0.45 μm, size distribution: 20%, tabular grains with an aspect ratio of 5) | 0.10 |
| Gelatin | 1.00 |
| Cyan Coupler (ExC-1) | 0.14 |
| Cyan Coupler (ExC-2) | 0.07 |
| Antifading Agent (Cpd-2, 3, 4, 9, in equal mols) | 0.12 |
| Coupler Dispersion Medium (Cpd-5) | 0.03 |
| Coupler Solvent (Solv-1, 2, 3, in equal volumes) | 0.06 |
| Fourth Layer: High-Sensitive Red-Sensitive Emulsion Layer | |
| Silver Iodobromide Emulsion EM3 Spectrally Sensitized with Red-Sensitizing Dyes (ExS-1, 2, 3, in equal mols) (silver iodide: 6 mol %, mean grain size: 0.75 μm, size distribution: 25%, core-iodine type tabular grains with an aspect ratio of 8) | 0.15 |
| Gelatin | 1.00 |
| Cyan Coupler (ExC-1) | 0.20 |
| Cyan Coupler (ExC-2) | 0.10 |
| Antifading Agent (Cpd-2, 3, 4, 9, in equal mols) | 0.15 |
| Coupler Dispersion Medium (Cpd-5) | 0.03 |
| Coupler Solvent (Solv-1, 2, 3) | |
| Fifth Layer: Interlayer | |
| Magenta Colloidal Silver | 0.02 |
| Gelatin | 1.00 |
| Color Mixing Preventing Agent (Cpd-6, 7) | 0.08 |
| Color Mixing Preventing Agent Solvent (Solv-4, 5, in equal volumes) | 0.16 |
| Polymer Latex Plasticizer (Cpd-8) | 0.10 |
| Sixth Layer: Low-Sensitive Green-Sensitive Emulsion Layer | |
| Silver Chlorobromide Emulsion EM4 Spectrally Sensitized with Green-Sensitizing Dye (ExS-3) (silver chloride: 1 mol %, silver iodide: 2.5 mol %, mean grain size: 0.28 μm, Grain size distribution: 12%, cubic core-iodine type core/shell grains) | 0.04 |
| Silver Iodobromide Emulsion EM5 Spectrally Sensitized with Green-Sensitizing Dye (ExS-3) (silver iodide: 2.8 mol %, mean grain size: 0.45 μm, grain size distribution: 12%, tabular grains with an aspect ratio of 5) | 0.06 |
| Gelatin | 0.80 |
| Magenta Coupler (ExM-1) | 0.10 |
| Antifading Agent (Cpd-9) | 0.10 |
| Stain Inhibitor (Cpd-10) | 0.01 |
| Stain Inhibitor (Cpd-11) | 0.001 |
| Stain Inhibitor (Cpd-12) | 0.01 |
| Coupler Dispersion Medium (Cpd-5) | 0.05 |
| Coupler Solvent (Solv-4, 6, in equal volumes) | 0.15 |
| Seventh Layer: High-Sensitive Green-Sensitive Emulsion Layer | |
| Silver Iodobromide Emulsion EM6 Spectrally Sensitized with Green-Sensitizing Dye (ExS-3) (silver iodide: 3.5 mol %, mean grain size: 0.9 μm, grain size distribution: 23%, uniform iodine type tabular grains with an aspect ratio of 9) | 0.10 |
| Gelatin | 0.80 |
| Magenta Coupler (ExM-1) | 0.10 |
| Antifading Agent (Cpd-9) | 0.10 |
| Stain Inhibitor (Cpd-10) | 0.01 |
| Stain Inhibitor (Cpd-11) | 0.001 |
| Stain Inhibitor (Cpd-12) | 0.01 |
| Coupler Dispersion Medium (Cpd-5) | 0.05 |
| Coupler Solvent (Solv-4, 6, in equal volumes) | 0.15 |
| Eighth Layer: Yellow Filter Layer | |
| Yellow Colloidal Silver | 0.20 |
| Gelatin | 1.00 |
| Color Mixing Preventing Agent (Cpd-7) | 0.06 |
| Color Mixing Preventing Agent Solvent (Solv-4, 5, in equal volumes) | 0.15 |
| Polymer latex (Cpd-8) | 0.10 |
| Ninth Layer: Low-Sensitive Blue-Sensitive Emulsion Layer | |
| Silver Chlorobromide Emulsion EM7 Spectrally Sensitized with Blue-Sensitizing Dyes (ExS-4, 5, in equal mols) (silver chloride: 2 mol %, silver iodide: 2.5 mol %, mean grain size: 0.35 μm, grain size distribution: 8%, cubic core-iodine type core/shell grains) | 0.07 |
| Silver Iodobromide Emulsion EM8 Spectrally Sensitized with Blue-Sensitizing Dyes (ExS-4, 5, in equal mols) (silver iodide: 2.5 mol %, mean grain size: 0.45 μm, grain size distribution: 16%, tabular grains with an aspect ratio of 6) | 0.10 |
| Gelatin | 0.50 |
| Yellow Coupler (ExY-1) | 0.20 |
| Stain Inhibitor (Cpd-11) | 0.001 |
| Coupler Solvent (Solv-2) | 0.05 |
| Tenth Layer: High-Sensitive Blue-Sensitive Emulsion Layer | |
| Silver Iodobromide Emulsion ME9 Spectrally Sensitized with Blue-Sensitizing Dyes (ExS-4, 5, in equal mols) (silver iodide: 2.5 mol %, mean grain size: 1.2 μm, grain size distribution: 21%, tabular grains with an aspect ratio of 14) | 0.25 |
| Gelatin | 1.00 |
| Yellow Coupler (ExY-1) | 0.40 |
| Stain Inhibitor (Cpd-11) | 0.002 |
| Coupler Solvent (Solv-2) | 0.10 |
| Eleventh Layer: Ultraviolet Absorbing Layer | |
| Gelatin | 1.50 |
| Ultraviolet Absorber (Cpd-1, 3, 13) | 1.00 |
| Color Mixing Preventing Agent (Cpd-6, 14) | 0.06 |
| Dispersion Medium (Cpd-5) | 0.05 |
| Ultraviolet Absorber Solvent (Solv-1, 2) | 0.15 |
| Antiirradiation Dye (Cpd-15, 16) | 0.02 |
| Antiirradiation Dye (Cpd-17, 18) | 0.02 |
| Twelfth Layer: Protective Layer | |
| Silver Chlorobromide Fine Grains | 0.07 |

-continued

| | |
|---|---|
| (silver chloride: 97 mol %, mean grain size: 0.2 μm) | |
| Acrylic Compound-Modified Poval | 0.02 |
| Gelatin | 1.50 |
| Gelatin Hardening Agent | 0.17 |
| $CH_2{=}CHSO_2{-}(CH_2{-})_3SO_2CH{=}CH_2$ | |

For the respective layers, Alkanol B (by Du Pont) and sodium alkylbenzenesulfonate as an emulsification and dispersion aid and succinic acid ester and Megafac F-120 (by Dai-Nippon Ink) as a coating aid were used. For the silver halide-containing layers and colloidal silver-containing layers, a mixture of (Cpd-19, 20, 21) was used as a stabilizer. The thus-prepared photographic material was called Sample No. 100.

The compounds used in Example 2 are described below.

ExS-1

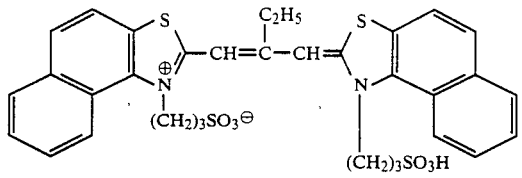

ExS-2

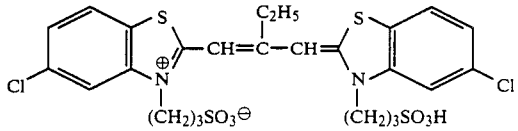

ExS-3

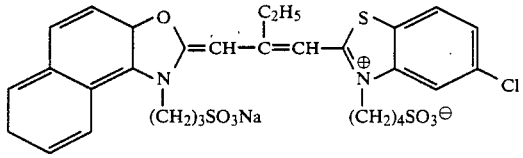

ExS-4

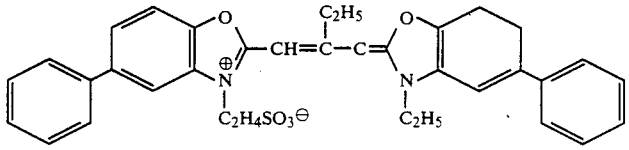

ExS-5

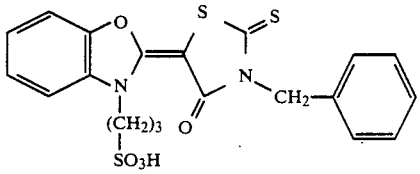

Cpd-1

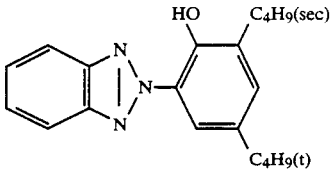

Cpd-2

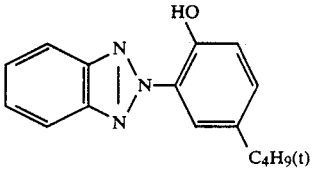

Cpd-3

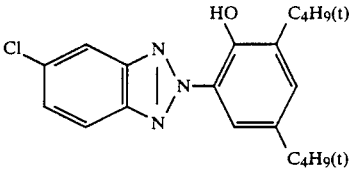

-continued
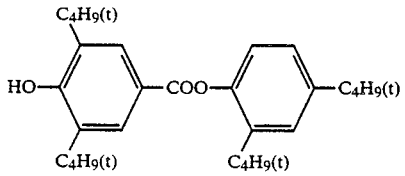
Cpd-4
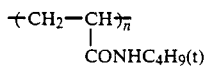
(n = 100 ~ 1000)
Cpd-5
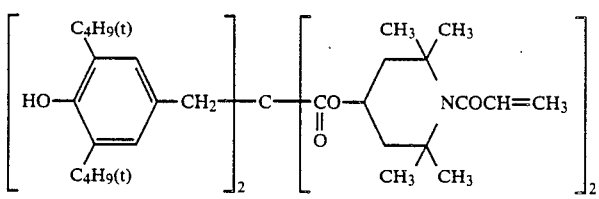
Cpd-6
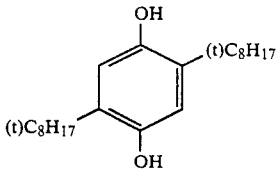
Cpd-7
Polyethyl Acrylate
Cpd-8
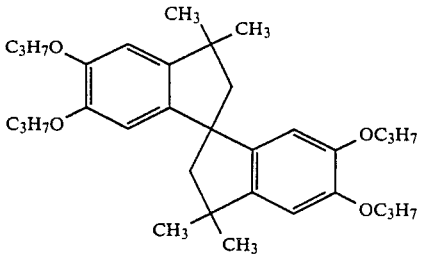
Cpd-9
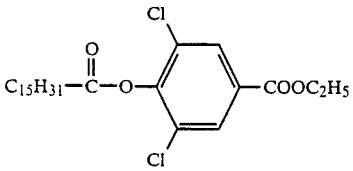
Cpd-10
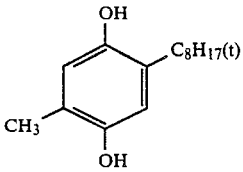
Cpd-11
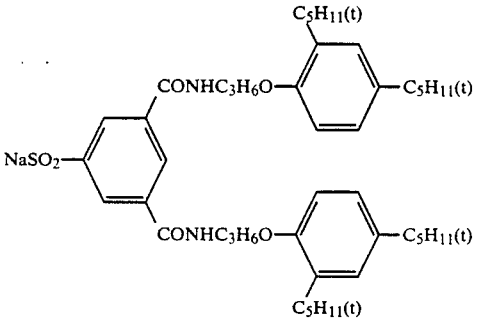
Cpd-12

-continued
Cpd-13
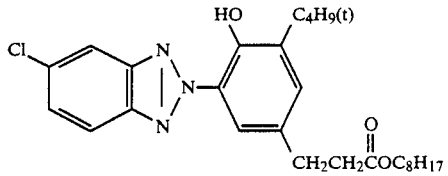
Cpd-14
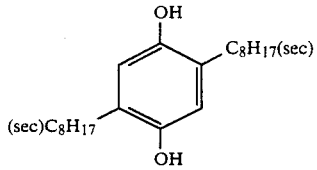
Cpd-15
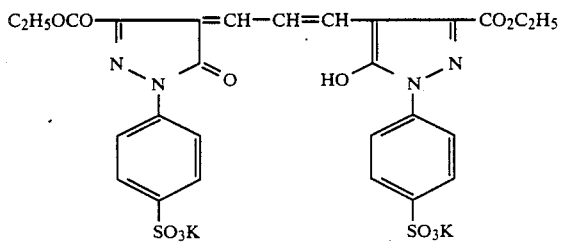
Cpd-16
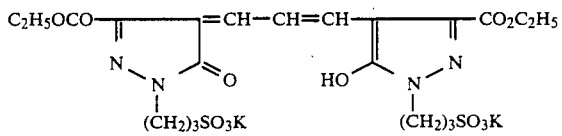
Cpd-17
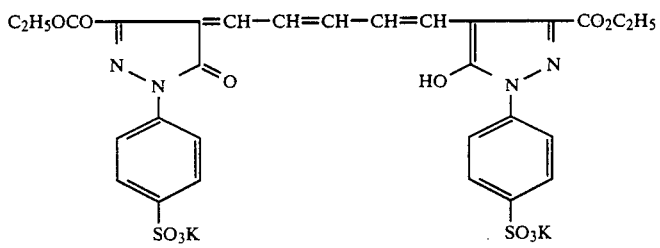
Cpd-18
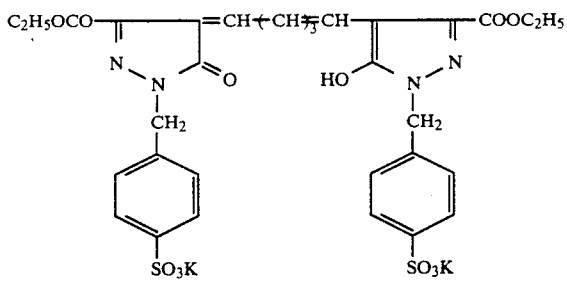
Cpd-19
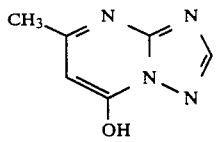
Cpd-20
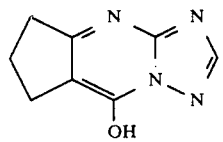

-continued

Cpd-21

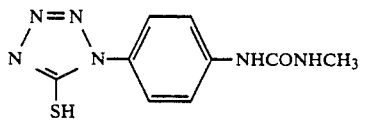

ExC-1

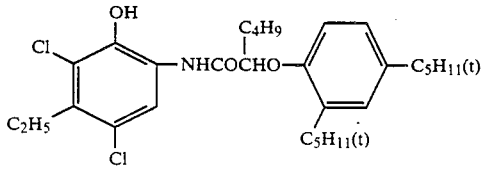

ExC-2

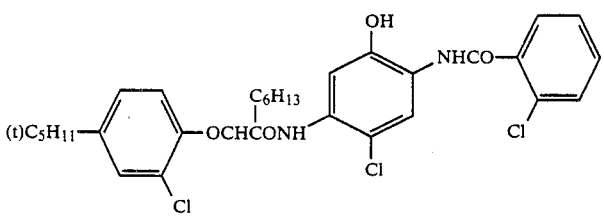

ExM-1

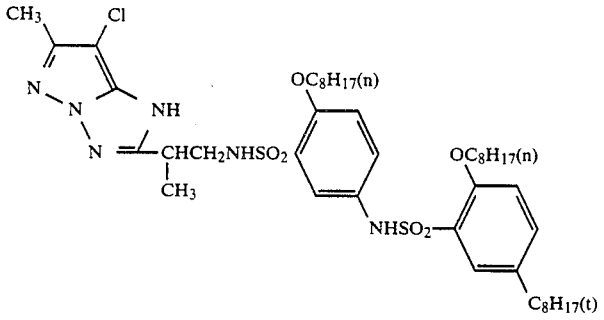

ExY-1

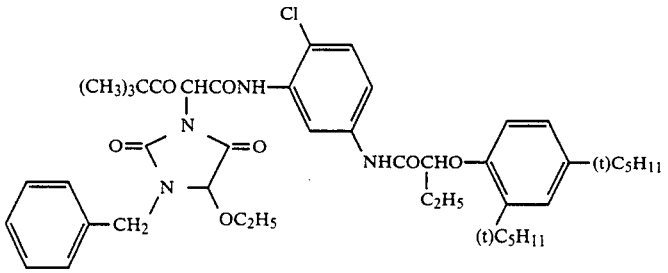

Solv-1: Di(2-ethylhexyl) Phthalate
Solv-2: Trinonyl Phosphate
Solv-3: Di(3-methylhexyl) Phthalate
Solv-4: Tricresyl Phosphate
Solv-5: Dibutyl Phthalate
Solv-6: Trioctyl Phosphate
Solv-7: 1,2-Bis(vinylsulfonylacetamido)ethane Other samples were also prepared in the same manner as the preparation of Sample No. 100 except that the yellow coupler in the ninth layer and the tenth layer was replaced by one of the yellow coupler of the present invention (Compound I-1 to I-20) and the coupler solvent was accordingly changed as indicated in Table 1 in Example 1 and the epoxy compound and polymer of the invention were added also as indicated in Table 1.

The thus-prepared samples were exposed for continuous gradation through a sensitometric optical wedge and then processed in accordance with the following steps:

| Processing Steps: | | |
|---|---|---|
| First Development (black-and-white development) | 38° C. | 1 min 15 sec |
| Rinsing in Water | 38° C. | 1 min 30 sec |
| Reversal Exposure | 100 lux or more | 1 sec or more |
| Color Development | 38° C. | 2 min 15 sec |
| Rinsing in Water | 38° C. | 45 sec |
| Bleach-Fixation | 38° C. | 2 min 00 sec |
| Rinsing in Water | 38° C. | 2 min 15 sec |

The processing solutions used had the following compositions.

| First Developer: | |
|---|---|
| Nitrilo-N,N,N-trimethylenephosphonic Acid Pentasodium Salt | 0.6 g |
| Diethylenetriaminepentaacetic Acid Pentasodium Salt | 4.0 g |
| Potassium Sulfite | 30.0 g |
| Potassium Thiocyanate | 1.2 g |

-continued

| | |
|---|---|
| Potassium Carbonate | 35.0 g |
| Hydroquinonemonosulfonate Potassium Salt | 25.0 g |
| Diethylene Glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1 l |
| | (pH 9.70) |
| Color Developer: | |
| Benzyl Alcohol | 15.0 ml |
| Diethylene Glycol | 12.0 ml |
| 3,6-Dithia-1,8-octanediol | 0.2 g |
| Nitrilo-N,N,N-trimethylenephosphonic Acid Pentasodium Salt | 0.5 g |
| Diethylenetriaminepentaacetic Acid Pentasodium Salt | 2.0 g |
| Sodium Sulfite | 2.0 g |
| Potassium Carbonate | 25.0 g |
| Hydroxylamine Sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1 l |
| | (pH 10.40) |
| Bleach-Fixing Solution: | |
| 2-Mercapto-1,3,4-triazole | 1.0 g |
| Ethylenediaminetetraacetic Acid Disodium Dihydrate | 5.0 g |
| Ammonium Ethylenediaminetetraacetic Acid Fe (III) Monohydrate | 80.0 g |
| Sodium Sulfite | 15.0 g |
| Sodium Thiosulfate (700 g/l solution) | 160.0 ml |
| Glacial Acetic Acid | 5.0 ml |
| Water to make | 1 l |
| | (pH 6.50) |

Each of the thus-developed samples was examined with respect to the light fastness, heat fastness and wet fastness. For the examination, each sample was incubated in the dark under conditions of 80° C. and 70% RH for 24 days or was irradiated with a xenon tester (85,000 lux) for 12 days and then the thus-incubated or irradiated samples were evaluated in the same manner as mentioned in Example 1. As a result, it was ascertained that the light fastness and heat fastness were extremely improved because of the combination of the epoxy compound and the polymer of the invention, like the samples in Example 1.

These examples demonstrate that the silver halide color photographic materials of the invention form excellent color images with improved yellow color image-storing stability because of the combination of the particular yellow coupler, epoxy compound and polymer, and that their photographic characteristics are not adversely affected by the incorporation of such epoxy compounds and polymers. In particular, the light fastness, heat fastness and wet fastness of the color images formed are significantly improved. Further, when the particular magenta coupler and cyan coupler of the invention are used in the materials of the present invention, color photographs having a well balanced and improved storage stability of all the yellow, magenta and cyan color images are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, at least one layer of the material containing a yellow coupler represented by formula (I), a sparingly water-soluble epoxy compound represented by formula (II) and a water-insoluble but organic solvent-soluble homopolymer or copolymer which comprises acrylamide or methacrylamide monomer units having at least one

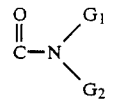

group, in which $G_1$ and $G_2$, which may be the or different, each represents hydrogen, a substituted or unsubstituted alkyl group or a substituted or unsubstituted aryl group:

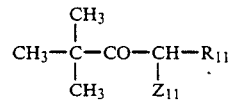

(I)

wherein $R_{11}$ represents a N-arylcarbamoyl group; and $Z_{11}$ represents a group capable of being released by a reaction with the oxidation product of an aromatic primary amine color developing agent; and

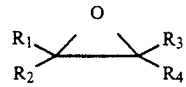

(II)

wherein $R_1$, $R_2$, $R_3$ and $R_4$, which may be the same or different, each represents hydrogen, an aliphatic group, an aromatic group, an aliphatic oxycarbonyl group, an aromatic oxycarbonyl group or a carbamoyl group; provided that at least one of $R_1$, $R_2$, $R_3$ and $R_4$ represents a group other than hydrogen; $R_1$, $R_2$, $R_3$ and $R_4$ contain a total of 8 to 60 carbon atoms; and $R_1$ and $R_2$, or $R_1$ and $R_3$ may be linked to form a 5-membered to 7-membered ring.

2. The silver halide color photographic material as claimed in claim 1, wherein said group $Z_{11}$ is selected from a halogen atom, an alkoxy group, an aryloxy group, an acyloxy group, a sulfonyloxy group, an amido group, an alkoxycarbonyloxy group, an aryloxycarbonyloxy group, an aliphatic thio group, an aromatic thio group, an imido group, and an N-heterocyclic group.

3. The silver halide color photographic material as claimed in claim 2, wherein $Z_{11}$ represents an aryloxy group, an imido group, or an N-heterocyclic group.

4. The silver halide color photographic material as claimed in claim 3, wherein $Z_{11}$ represents an imido group or an N-heterocyclic group.

5. The silver halide color photographic material as claimed in claim 4, wherein $Z_{11}$ in formula (I) is represented by formulae (III) or (IV):

(III)

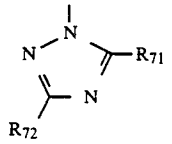

(IV)

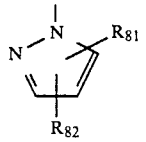

wherein $R_{71}$, $R_{72}$, $R_{81}$ and $R_{82}$, which may be the same or different, each represents hydrogen, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl group or an unsubstituted or substituted heterocyclic group.

6. The silver halide color photographic material as claimed in claim 4, wherein $Z_{11}$ in formula (I) is represented by formula (V):

(V)

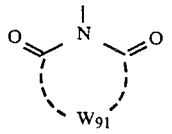

wherein $W_{91}$ represents a nonmetallic atomic group necessary for forming a 5-membered or 6-membered ring.

7. The silver halide color photographic material as in claim 6, wherein the group represented by formula (V) is selected from groups represented by formulae (VI) to (VIII):

(VI)

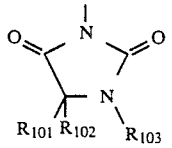

(VII)

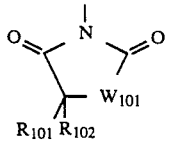

(VIII)

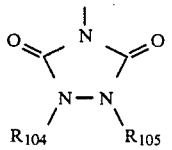

$R_{101}$ and $R_{102}$, which may be the same or different, each represents hydrogen, an alkyl group, an aryl group, an alkoxy group, an aryloxy group or a hydroxyl group; $R_{103}$, $R_{104}$ and $R_{105}$, which may be the same or different, each represents hydrogen, an alkyl group, an aryl group, an aralkyl group or an acyl group; and $W_{101}$ represents oxygen or sulfur.

8. The silver halide color photographic material as claimed in claim 1, wherein said yellow coupler represented by formula (I) is represented by formula (I-A):

(I-A)

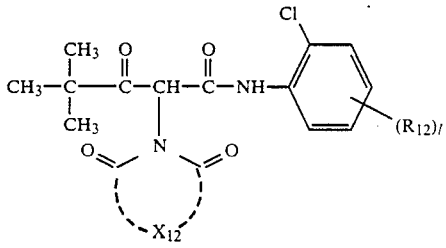

wherein $X_{12}$ represents a nonmetallic atomic group necessary for forming a 5-membered ring; and $R_{12}$ represents an aliphatic group, an aliphatic oxy group, an aromatic oxy group, an ester group, an amido group, an imido group or a halogen atom; and l is an integer of from 1 to 4.

9. The silver halide color photographic material as claimed in claim 8, wherein said 5-membered ring formed by $X_{12}$ is represented by formulae (VI), (VII) or (VIII):

(VI)

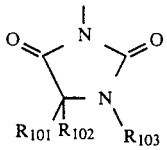

(VII)

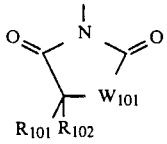

(VIII)

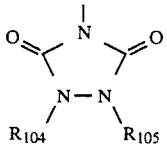

wherein $R_{101}$ *and* $R_{102}$, which may be the same or different, each represents hydrogen, an alkyl group, an aryl group, an alkoxy group, an aryloxy group, or a hydroxyl group; $R_{103}$, $R_{104}$ and $R_{105}$, which may be the same or different, each represents hydrogen, an alkyl group, an aryl group, an aralkyl group, or an acyl group; and $W_{101}$ represents oxygen or sulfur.

10. The silver halide color photographic material as claimed in claim 9, wherein said 5-membered ring formed by $X_{12}$ is represented by formulae (VI) or (VII).

11. The silver halide color photographic material as claimed in claim 10, wherein in formula (VI) at least one of $R_{101}$ and $R_{102}$ represents a substituent other than hydrogen.

12. The silver halide color photographic material as claimed in claim 1, wherein said aliphatic group and said aromatic group represented by $R_1$, $R_2$, $R_3$ and $R_4$ each is unsubstituted or substituted with a substituent selected from the group consisting of an alkyl group, an aryl group, a heterocyclic group, an alkoxy group, an aryloxy group, an alkenyloxy group, an acyl group, an ester group, an amido group, a sulfamido group, an imido group, a ureido group, an aliphatic sulfonyl group, an aromatic sulfonyl group, an aliphatic thio group, an aromatic thio group, a hydroxyl group, a cyano group, a carboxyl group, a nitro group, a sulfo group, and a halogen atom.

13. The silver halide color photographic material as claimed in claim 1, wherein said polymer is a homopolymer having a molecular weight of at least 20,000 and a glass transition point of at least 50° C.

14. The silver halide color photographic material as claimed in claim 13, wherein said homopolymer has a glass transition point of at least 80° C. and a molecular weight of at most 30,000.

15. The silver halide color photographic material as claimed in claim 1, wherein said yellow coupler represented by formula (I), said epoxy compound represented by formula (II) and said homopolymer or copolymer are present in said light-sensitive silver halide emulsion layer.

16. The silver halide color photographic material as claimed in claim 1, comprising from 0.01 to 2 mol of said yellow coupler per mol of said silver halide; from 5% by weight to 300% by weight of said epoxy compound based on said yellow coupler; and from 10% by weight to 300% by weight of said homopolymer or copolymer based on said yellow coupler.

17. The silver halide color photographic material as claimed in claim 15, wherein said yellow coupler represented by formula (I), said epoxy compound represented by formula (II), and said homopolymer or copolymer are dissolved in droplets which are emulsified and dispersed in the light-sensitive silver halide emulsion layer.

18. The silver halide color photographic material as claimed in claim 1, said homopolymer or copolymer has a relative quantum yield of fluorescence of 0.2 or more.

* * * * *